US009778590B2

(12) United States Patent
Nishimura et al.

(10) Patent No.: US 9,778,590 B2
(45) Date of Patent: Oct. 3, 2017

(54) CHARGING DEVICE, PROCESS CARTRIDGE, AND IMAGE FORMING APPARATUS

(71) Applicant: Sharp Kabushiki Kaisha, Osaka (JP)

(72) Inventors: Yasuhiro Nishimura, Osaka (JP); Tohru Sakuwa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/210,285

(22) Filed: Jul. 14, 2016

(65) Prior Publication Data

US 2017/0031262 A1 Feb. 2, 2017

(30) Foreign Application Priority Data

Jul. 30, 2015 (JP) ..... 2015-150443

(51) Int. Cl.
*G03G 15/02* (2006.01)

(52) U.S. Cl.
CPC ..... *G03G 15/0291* (2013.01)

(58) Field of Classification Search
None
See application file for complete search history.

(56) References Cited

U.S. PATENT DOCUMENTS 5,351,111 A * 9/1994 Takafuji ..... G03G 15/0291 250/324
2007/0098445 A1* 5/2007 Takiguchi ..... G03G 15/0266 399/171
2007/0217822 A1* 9/2007 Deguchi ..... G03G 15/0233 399/171
2008/0304866 A1* 12/2008 Takenaka ..... G03G 15/0291 399/175
2009/0116873 A1* 5/2009 Kadowaki ..... G03G 15/0291 399/171
2010/0221043 A1* 9/2010 Gotoda ..... G03G 15/0291 399/171
2013/0272723 A1* 10/2013 Imazeki ..... G03G 15/5079 399/8

FOREIGN PATENT DOCUMENTS

JP 2009-251310 10/2009

* cited by examiner

*Primary Examiner* — Thomas Giampaolo, II
(74) *Attorney, Agent, or Firm* — Renner, Otto, Boisselle & Sklar, LLP

(57) ABSTRACT

To provide a charging device which can be reduced in size and increased in speed while suppressing the occurrence of charging irregularities on the surface of the photosensitive drum, a process cartridge, and an image forming apparatus. A charging device 311Y which charges a surface of a photosensitive drum 310Y, comprises a discharge electrode 610 which applies a potential to the surface of the photosensitive drum 310Y and charges the surface, and a grid electrode 670 with a porous place shape disposed between the discharge electrode 610 and the surface of the photosensitive drum 310Y so as to face the surface of the photosensitive drum 310Y and which controls the charging potential of the surface, wherein the grid electrode 670 is divided into a plurality of regions approximately parallel to a direction orthogonal to a direction of rotation of the photosensitive drum 310Y, and the plurality of regions is characterized in that an opening ratio of a midstream region 672 close to the photosensitive drum 310Y is greater than an opening ratios of an upstream region 671 and a downstream region 673.

16 Claims, 7 Drawing Sheets

CHARGING DEVICE, PROCESS CARTRIDGE, AND IMAGE FORMING APPARATUS

This application is based on and claims the benefit of priority from Japanese Patent Application No. 2015-150443, filed on 30 Jul. 2015, the content of which is incorporated herein by reference.

BACKGROUND OF THE INVENTION

Field of the Invention

The present invention relates to a charging device which charges a photosensitive drum, to a process cartridge having this charging device, and to an image forming apparatus provided with this process cartridge.

Related Art

In the prior art, electrophotographic type image forming apparatus use a charging device for uniformly charging the surface of a photosensitive drum as an image support body, and as such a charging device, scorotron charging devices have been known.

A scorotron charging device is provided with a discharge electrode which carries out corona discharge for the photosensitive drum and charges the photosensitive drum, a grid electrode for controlling the amount of the charge applied to the surface of the photosensitive drum by the discharge electrode, and a shield case in which they are housed; wherein the grid electrode can almost accurately control the charging potential of the surface of the photosensitive drum, and as a result it is widely used as a charging device for a photosensitive drum.

Particularly, a scorotron charging devices combining a grid electrode of a porous plate shape where a plurality of through-holes are formed with a mesh shape or slit shape on a metal plate (grid substrate) consisting of stainless steel or the like, and discharge electrodes having a plurality of acutely shaped protruding portions have attracted attention because they have little adhesion of dirt to the grid electrode and they can uniformly charge the surface of the photosensitive drum, and various improvements have been proposed (for example, refer to Patent Document 1).

Patent Document 1: Japanese Unexamined Patent Application, Publication No. 2009-251310

SUMMARY OF THE INVENTION

Herein, for the above described scorotron charging device, in general the width of the shield case, the opening ratio of the grid electrode and the like are designed to yield a balance of the charging performance of the photosensitive drum, and controllability and uniformity in the long direction of the photosensitive drum. On the other hand, recently, it has been desired to further decrease the size and increase the speed of image forming apparatus, and there is also the need to decrease the size and increase the speed of scorotron charging devices.

However, when reducing the width of the shield case in order to reduce the size of a scorotron charging device, and further increasing the opening ratio of the grid electrode in order to increase the speed, it becomes difficult to achieve the coexistence of the above described charging performance of the photosensitive drum and the controllability and uniformity in the long direction of the photosensitive drum, and there is concern that irregularities in the charging of the surface of the photosensitive drum may arise.

Thus, the present invention has the objective of providing a charging device with reduced size and increased speed while suppressing the occurrence of charging irregularities on the surface of the photosensitive drum, a process cartridge having this charging device, and an image forming apparatus provided with this process cartridge. The present invention is a charging device which is disposed so as to face a surface of a photosensitive drum and which charges the surface of the photosensitive drum, comprising: a discharge electrode, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions in a direction along a direction of rotation of the photosensitive drum, and the plurality of regions is set such that an opening ratio of a region close to the photosensitive drum is greater than an opening ratio of another region. In addition, the present invention is a process cartridge comprising the charging device above, a photosensitive drum which is charged by the charging device, and a developing device which develops an electrostatic latent image formed on the photosensitive drum by an exposure device and forms a toner image. Further, the present invention is an image forming apparatus comprising an image forming portion comprising the process cartridge above, the exposure device, a transfer means which transfers the toner image formed on the photosensitive drum to a sheet, and a fixing means which fixes the toner image transferred to the sheet onto the sheet, and a sheet feed portion which feeds a sheet to the image forming portion. Still further, the present invention is an image forming apparatus comprising a photosensitive drum, a charging unit, disposed so as to face a surface of the photosensitive drum, for charging the surface of the photosensitive drum and a developing unit for forming a toner image on the surface of the photosensitive drum by developing a latent image formed on the surface of the charged photosensitive drum, wherein the developing unit comprises a developing roll, comprising a developing sleeve which supports a developer on a surface, for adhering a toner included in the developer onto the photosensitive drum, and a developer layer thickness control member for controlling a layer thickness of the developer in the developing sleeve, for adjusting an amount of the toner adhering to the photosensitive drum, and wherein the developer is compacted by its own weight and a force originating from rotation towards the developer layer thickness control member of the developing sleeve, and a film thickness of the compacted developer is controlled by the developer layer thickness control member, the charging unit comprises a discharge electrode of a saw blade shape having a plurality of acutely shaped protruding portions, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions in a direction along a direction of rotation of the photosensitive drum, and the plurality of regions are set such that an opening ratio of a region close to the photosensitive drum is greater than the opening ratio of another region. Yet still further, the present invention is An image forming apparatus comprising a photosensitive drum, a charging unit, disposed so as to face a surface of the photosensitive drum, for charging the surface of the photosensitive drum and a developing unit for forming a toner image on the surface of the photosensitive drum by developing a latent image formed on the surface of the charged photosensitive drum, wherein the developing unit comprises a developing roll, comprising a developing sleeve which supports a developer on a surface, for adhering a toner included in the developer onto the photosensitive drum, and a developer layer thickness control member for controlling a layer thickness of the developer in the developing sleeve, for adjusting an amount of the toner adhering to the photosensitive drum, and wherein the developer is compacted by its own weight and a force originating from rotation towards the developer layer thickness control member of the developing sleeve, and a film thickness of the compacted developer is controlled by the developer layer thickness control member, the charging unit comprises a discharge electrode of a wire shape, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions in a direction along a direction of rotation of the photosensitive drum, and the plurality of regions are set such that an opening ratio of a region close to the photosensitive drum is greater than the opening ratio of another region.

According to the present invention, a charging device can be reduced in size and increased in speed while suppressing the generation of charging irregularities of the surface of the photosensitive drum.

DETAILED DESCRIPTION OF THE INVENTION

The image forming apparatus according to the present invention will be explained with reference to the drawings. The image forming apparatus according to the present embodiment is a copier, printer, facsimile device, a combination of these, or the like, and below an explanation is given using an electrophotographic type laser beam printer which is capable of forming an image at high speed with a process speed on the order of 320 to 375 mm/sec (below simply referred to as "printer") as one example of the image forming apparatus.

First Embodiment

Figure 1:
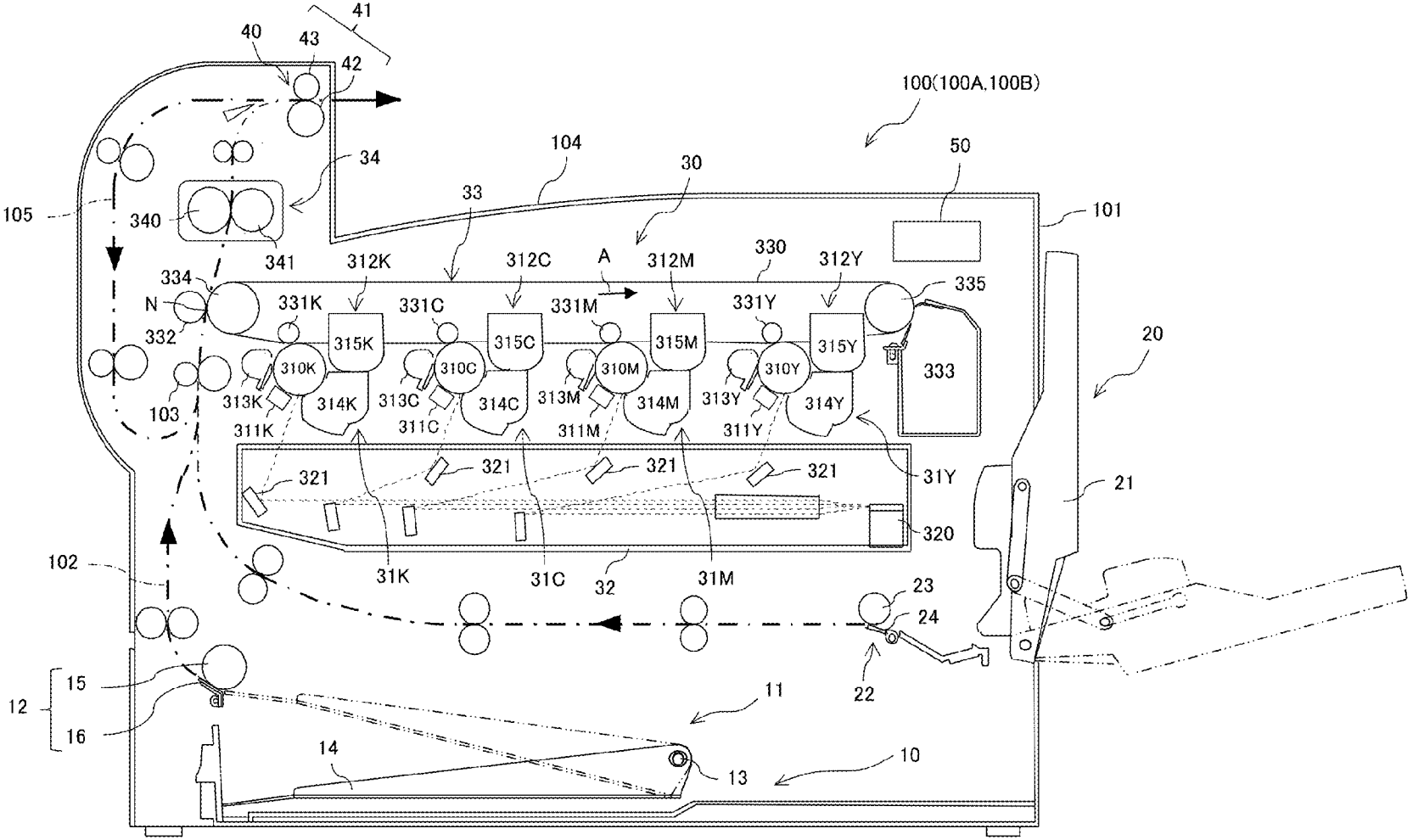
FIG. 1 is a cross sectional view schematically showing a printer according to the first embodiment of the present invention.
Figure 2:
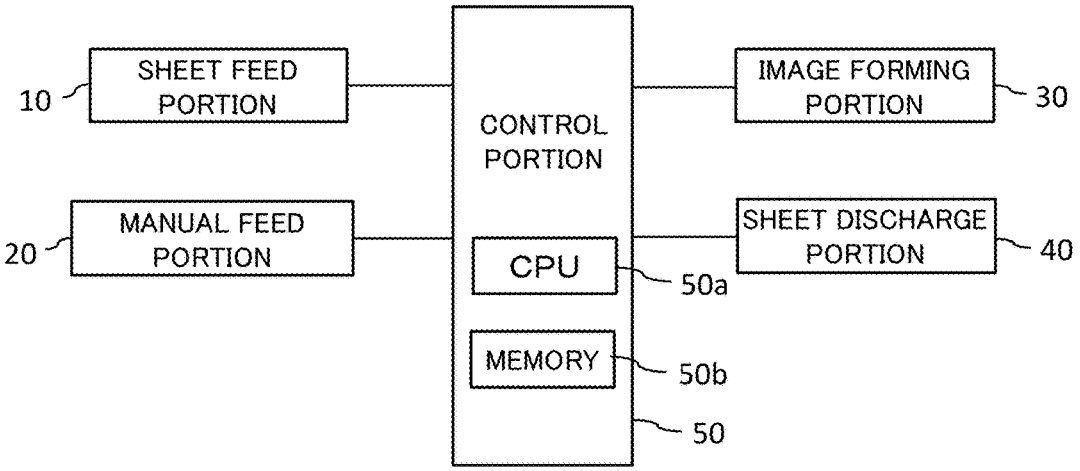
FIG. 2 is a block diagram showing in outline the functioning of a printer according to the first embodiment.

The printer 100 according to the first embodiment will be explained with reference to FIGS. 1 to 5. First, an outline of the constitution of the printer 100 according to the first embodiment is explained with reference to FIGS. 1 and 2. FIG. 1 is a cross sectional view schematically showing the printer 100 according to the first embodiment of the present invention. FIG. 2 is a block diagram schematically showing in outline the functioning of the printer 100 according to the first embodiment.

As shown in FIG. 1, the printer 100 is provided with a sheet feed portion 10 which feeds sheets, a manual feed portion 20 which can feed sheets manually, an image forming portion 30 which forms an image on a sheet fed by the sheet feed portion 10 or the manual feed portion 20, a sheet discharge portion 40 which discharges to the outside of the device a sheet on which an image has been formed, and a control portion 50 which controls these.

The sheet feed portion 10 is provided with a feed sheet loading portion 11 which loads and accommodates sheets, and a segregated feed portion 12 which segregates and feeds the sheets which have been loaded in the feed sheet loading portion 11 one at a time. The feed sheet loading portion 11 is provided with an intermediate plate 14 which rotates about the rotation axis 13, and when feeding a sheet the intermediate plate 14 rotates and lifts a sheet upwards (the state of the double dot and dash line shown in FIG. 1). The segregated feed portion 12 is provided with a pickup roller 15 which feeds the sheet lifted by the intermediate plate 14, and a segregation pad 16 which pressure-contacts the pickup roller 15.

The manual feed portion 20 is provided with a manual tray 21 which can be loaded with sheets, and a segregated feed portion 22 which is capable of feeding while segregating one at a time the sheets loaded into the manual tray 21. The manual tray 21 is supported so as to be freely rotatable on the printer main body 101 and for manual feeding, by rotating, a sheet can be loaded (the state of the double dot and dash line shown in FIG. 1). The segregated feed portion 22 is provided with a feed roller 23 which feeds a sheet loaded into the manual tray 21, and a segregation pad 24 which pressure-contacts the feed roller 23.

The image forming portion 30 is provided with four process cartridges (image forming units) 31Y to 31K which form yellow (Y), magenta (M), cyan (C) and black (K) images, an exposure device 32 which exposes the surfaces of the later described photosensitive drums 310Y to 310K, a transfer portion (transfer means) 33 which transfers toner images formed on the surfaces of the photosensitive drums 310Y to 310K, and a fixing portion (fixing means) 34 which fixes a non-fixed toner image transferred to the sheet. In the present embodiments, the image forming portion 30 is set so as to allow high speed image formation with a process speed on the order of 320 to 375 mm/sec.

Each of the four process cartridges 31Y to 31K is constituted so as to be removable from the printer main body 101 and to be replaceable. Further, the four process cartridges 31Y to 31K have the same constitution other than differing in the color of the formed image, and therefore, by explaining the constitution of the process cartridge 31Y which forms a yellow (Y) image, the explanations of the process cartridges 31M to 31K may be omitted. Further, the letters at the end of the reference symbols (Y, M, C, and K) respectively indicate colors (yellow, magenta, cyan, and black).

The process cartridge 31Y is provided with a photosensitive drum 310Y as an image support body, a scorotron charging device (below simply referred to as "charging device") 311Y which charges the photosensitive drum 310Y, a developing device 312Y which develops the electrostatic latent image formed on the photosensitive drum 310Y, and a cleaner unit 313Y which removes toner remaining on the surface of the photosensitive drum 310Y.

The photosensitive drum 310 is formed in an approximately cylindrical shape, and is supported so that it can be rotationally driven about a rotation axis by a driving means which is not shown. Further, the photosensitive drum 310Y has a conductive substrate, and a photosensitive layer formed on the surface of the conductive substrate. The conductive substrate may be formed in a cylindrical shape, columnar shape, a thin film shape or the like, and in the present embodiment, it is formed in a cylindrical form. The photosensitive layer is formed by laminating a charge generating layer having a charge generating substance, and a charge transporting layer having a charge transporting substance, and an undercoat layer is preferably disposed between the charge generating layer and the charge transporting layer. The charging device 311Y faces the surface of the photosensitive drum 310Y, and is disposed along the long direction of the photosensitive drum 310Y. Further, the charging device 311Y is explained in detail later.

The developing device 312Y is disposed to face the surface of the photosensitive drum 310Y, at a downstream side of the charging device 311Y in the direction of rotation of the photosensitive drum 310Y, and is provided with a developing device main body 314Y which develops with toner the electrostatic latent image formed on the surface of the photosensitive drum 310Y, and a toner cartridge 315Y which supplies toner to the developing device main body 314Y. The toner cartridge 315Y is constituted to be removable from the developing main body 314Y, and when the accommodated toner is depleted, it is removed from the developing device main body 314Y, and can be exchanged. The cleaner unit 313Y is disposed at the downstream side of the developing device 312Y in the direction of rotation of the photosensitive drum 310Y.

The exposure device 32 is provided with a light source 320 which outputs laser light, and a plurality of mirrors 321 and the like which guide the laser light onto the surface of the photosensitive drums 310Y to 310K.

The transfer portion 33 is provided with a primary transfer belt 330 which supports a toner image formed on the photosensitive drums 310Y to 310K, primary transfer rollers 331Y to 331K which primarily transfer the toner image formed on the photosensitive drums 310Y to 310K to the primary transfer belt 330, a secondary transfer roller 332 which secondarily transfers the toner image supported on the primary transfer belt 330 to a sheet, and a cleaner unit 333 which removes remaining toner on the primary transfer belt 330. The primary transfer belt 330 spans the driving roller 334 and the driven roller 335, and is urged to the photosensitive drums 310Y to 310K by the primary transfer rollers 331Y to 331K, respectively. The secondary transfer roller 332 nips the primary transfer belt 330 with the driving roller 334, and the toner image supported on the primary transfer belt 330 is transferred to the sheet by the nip portion N.

The fixing portion 34 is provided with the heating roller 340 which heats the sheet, and the pressing roller 341 which presses the heating roller 340. The sheet discharge portion 40 is provided with the discharge roller pair 41, and the discharge roller pair 41 is provided with a discharge roller 42 which can rotate in both directions, and a driven roller 43 which is driven to rotate by the discharge roller 42.

As shown in FIG. 2, the control portion 50 is provided with a CPU 50*a* which drives and controls the sheet feed portion 10, the manual feed portion 20, image forming portion 30, and the sheet discharge portion 40, and the memory 50*b* which stores various programs and varied information. Using these, the control portion 50 integrates and controls the operations of the sheet feed portion 10, the manual feed portion 20, the image forming portion 30, and the sheet discharge portion 40, to form an image on the sheet.

Next, the image forming operation (image forming control by the control portion 50) by the printer 100 which is constituted as described above will be explained. For the present embodiment, an explanation is given using the image forming operation for forming an image on a sheet S loaded into the feed sheet loading portion 11, based on image information input from an external PC.

When image information is input to the printer 100 from an external PC, the exposure device 32 irradiates laser light towards the photosensitive drums 310Y to 310K based on the input image information. At this time, the photosensitive drums 310Y to 310K have been charged in advance by the charging devices 311Y to 311K, respectively, and an electrostatic latent image is formed on the photosensitive drums 310Y to 310K by the irradiation with the laser light. After this, the electrostatic latent image is developed by the developing devices 312Y to 312K, and yellow (Y), magenta (M), cyan (C) and black (K) toner images are formed on the photosensitive drums 310Y to 310K, respectively. The toner images of each color formed on the photosensitive drums 310Y to 310K are sequentially superimposed and transferred to the primary transfer belt 330 rotating in the direction of the arrow A by the primary transfer rollers 331Y to 331K, and the superimposed transferred toner image (full color toner image) is delivered to the nip portion N by the primary transfer belt 330.

In parallel with the above described image forming operation, sheets loaded in the feed sheet loading portion 11 are fed one at a time to the sheet conveyance path 102 by the segregated feed portion 12. Then, by the resist roller pair 103 which is in downstream of the sheet conveyance path 102, it is conveyed to the nip portion N with a corrected inclination as well as a prescribed timing, and at the nip portion N a toner image on the primary transfer belt 330 is transferred. The sheet on which the toner image is transferred is heated and pressed at the fixing portion 34 to fuse and fix the toner image, and is discharged to the outside of the device by the discharge roller pair 41. The sheet discharged to the outside of the device is then loaded onto the discharged sheet loading portion 104 provided at the upper face of the printer main body 101.

Further, in the case of forming an image on both faces (first face and second face) of a sheet, before a sheet where an image is formed on a first face (front face) is discharged to the discharged sheet loading portion 104, the discharge roller 42 is made to rotate in reverse and the sheet is conveyed to the double-sided conveyance path 105, and is re-conveyed to the image forming portion 30 via the double-sided conveyance path 105. Then, an image is formed on the second face (rear face) in the same way as for the first face, and is discharged to the outside of the device.

Figure 3:
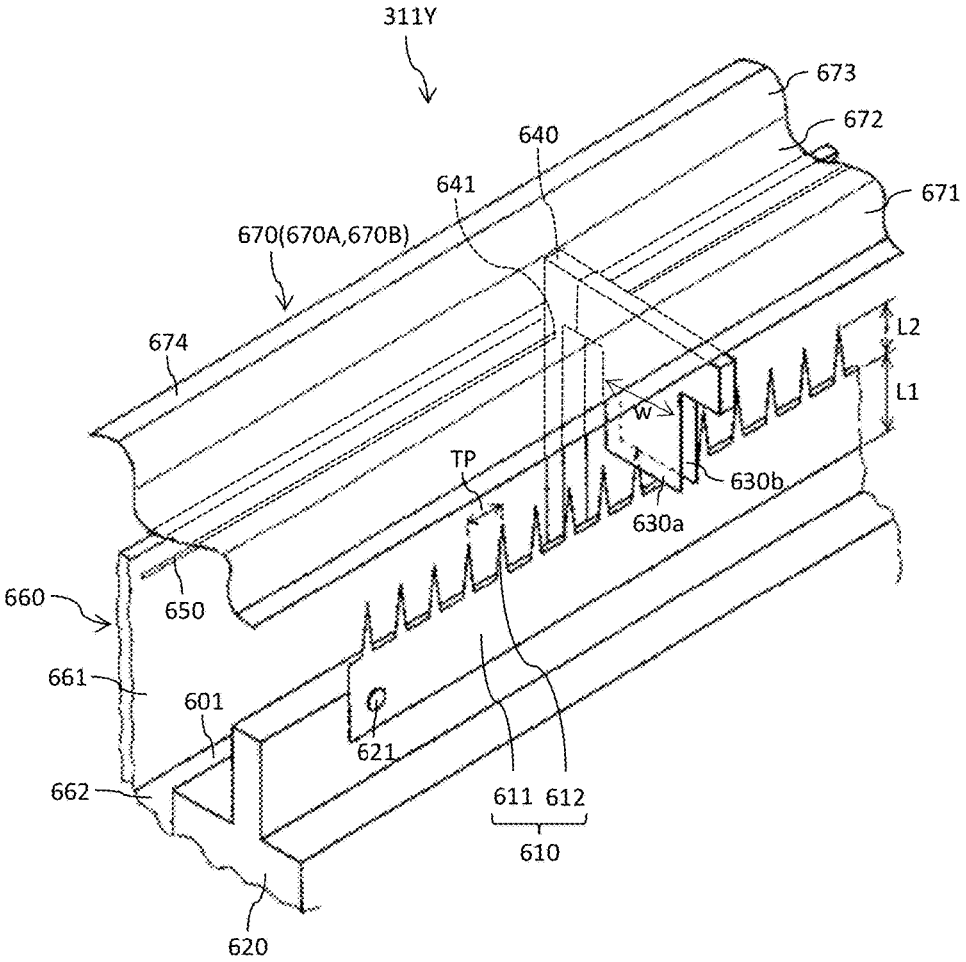
FIG. 3 is an oblique view schematically showing a charging device according to the first embodiment.
Figure 4:
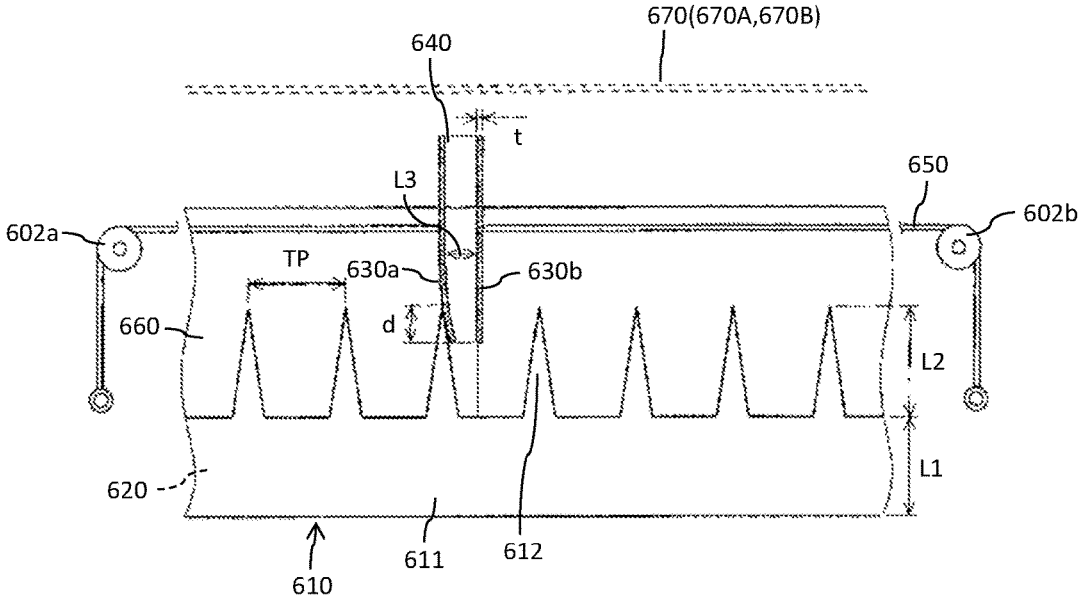
FIG. 4 is a front view of the charging device shown in FIG. 3.
Figure 5A:
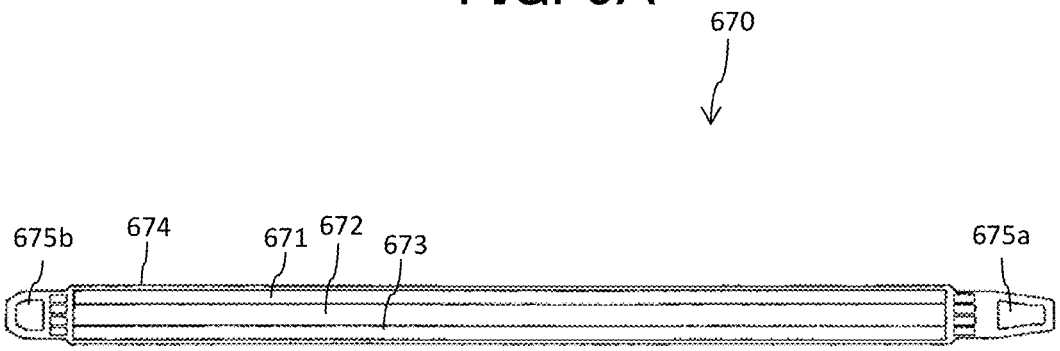
FIG. 5A is a drawing schematically showing a grid electrode according to the first embodiment.
Figure 5B:
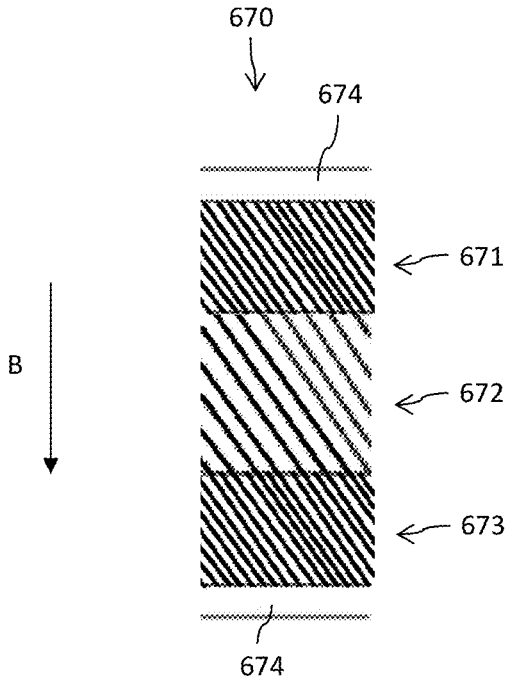
FIG. 5B is an expanded partial drawing schematically showing the grid electrode according to the first embodiment.

Next, the above described charging device 311Y will be explained in detail with reference to the FIGS. 3 to 5. First, a summarized constitution of the charging device 311Y will be explained with reference to FIGS. 3 to 5. FIG. 3 is an oblique view schematically showing the charging device 311Y according to the first embodiment. FIG. 4 is a front view of the charging device 311Y shown in FIG. 3. FIG. 5 is a drawing schematically showing a grid electrode according to the first embodiment.

As shown in FIG. 3 and FIG. 4, the charging device 311Y is provided with the discharge electrode 610, a retaining member 620, cleaning members 630*a* and 630*b*, a support member 640, a movement member 650, a shield case 660, and a grid electrode 670.

The discharge electrode 610 is provided with a plate portion 611 which extends lengthwise in one direction and which is, for example, a thin plate shaped member made of stainless steel, and a protruding portion (acutely shaped protruding portion) 612 having an acute shape formed so as to protrude in the short direction from one end portion of the short direction of the plate portion 611. In the present embodiment, the length L1 of the short direction of the plate portion 611 is 10 mm, and the length L2 in the protruding direction of the protruding portions 612 is 2 mm, the radius of curvature R of the tips of the protruding portions 612 is 40 μm, and the pitch TP at which the protruding portions 612 are formed is 2 mm. The discharge electrode 610 is electrically contacted to a power source, not shown in the drawings, and a corona discharge is carried out for the photosensitive drum 310Y by the application of a voltage from the power source. In the present embodiment, in the operation of charging the photosensitive drum 310Y, a corona discharge is carried out by applying a voltage on the order of 5 kV to the discharge electrode 610.

As long as the discharge electrode carries out corona discharge, the shape of the discharge electrode may be changed to different one such as sawtooth shape and a needle shape, and the discharge electrode may be a wire electrode.

The discharge electrode 610 is produced, for example, by a production method comprising a chemical polishing step, a water washing step, an acid immersion step, a water washing step, and a pure water immersion step. In the chemical polishing step, by carrying out masking and etching of a sheet metal, a plurality of needle shapes are formed on the sheet metal. The etching may be implemented according to a well known method, for example, a method of spraying an etching solution of ferric chloride aqueous solution or the like onto the sheet metal. Herein, as the metal which is the material of the sheet metal, one which allows the manufacture of a needle shaped electrode form and which can further be plated may be used, for example, stainless steel, aluminum, nickel, copper, iron and the like may be mentioned. Among these, stainless steel is preferable. As a specific example of a stainless steel, for example, SUS304, SUS309, SUS316 and the like may be mentioned, and among these, SUS304 is preferable. The thickness of the sheet metal is not particularly limited, but 0.05 to 1.0 mm is preferable, and 0.05 to 0.3 mm is more preferable. In the water washing step, acid immersion step, water washing step and pure water immersion step, the sheet metal with formed needle shapes obtained by the chemical polishing step is washed with water, cleaned with acid and cleaned with pure water, whereby contaminants are removed from its surface, and a needle shape electrode substrate is obtained. This needle shape electrode substrate may be used as-is as the discharge electrode 610.

A nickel layer containing polytetrafluoroethylene particles (below referred to as "nickel-PTFE composite layer") may also be formed on the surface of the discharge electrode 610. Below, polytetrafluoroethylene is referred to as PTFE. By forming a nickel layer comprising polytetrafluoroethylene particles, the adhesion onto to the grid electrode of nitrogen oxides which are byproducts of the discharge by the discharge electrode is prevented. Therefore, the grid electrode 670 can exhibit a stable discharge amount control function to uniformly charge the surface of the photosensitive drum 310Y without an accompanying increase in the discharge current amount over long periods. Further, by forming a nickel layer containing polytetrafluoroethylene particles on at least one surface of the discharge electrode 610, it is possible to easily remove matter attached to the tips of the discharge electrode 610 with a cleaning member or the like having a simple structure, and a stable charging of the surface of the photosensitive drum 310 is obtained without changes in the discharge amount of the discharge electrode 610 over long periods.

The nickel PTFI composite layer can be preferably formed by a plating method. For example, by sequentially applying a nickel plating and a nickel PTFE plating on the needle shaped electrode substrate, it is possible to form a nickel PTFE composite plating layer. Further, the nickel plating is not necessary, and only nickel PTFE composite plating may be carried out. The nickel plating may be implemented according to a well known method, but in consideration of later forming a nickel PTFE composite plating layer, it is preferable to carry out electroplating. Further, the layer thickness of the nickel plating layer is not particularly limited, and is preferably 0.03 to 3.0 μm, more preferably 0.5 to 1.5 μm, and particularly preferably on the order of 1.0 μm. The nickel PTFE composite plating is preferably implemented according to an electroless plating method such as a catalytic nickel plating method (Kanigen process) or the like.

Herein, as the plating bath, for example, it is possible to use a plating bath where polytetrafluoroethylene is further added to an aqueous solution comprising hypophosphoric acid or a salt thereof and a nickel salt. The pH of the plating bath is usually adjusted to within the range of 5.0 to 5.5. Herein, the used PTFE is in particle form, and the particle diameter thereof is not particularly limited provided that it is smaller than the thickness of the plating layer to be formed, and is preferably 10 to 20 vol %. The layer thickness of the formed nickel PTFE composite plating layer is not particularly limited, and preferably is greater than the particle diameter of the PTFE particles, and more preferably is from 2 times the particle diameter of the PTFE particles to 20 μm, and particularly preferably from 2 times the particle diameter of the PTFE particles to 10 μm. If the thickness is less than the particle diameter of the PTFE particles, pin holes will occur due to lacuna of the particle diameter of the PTFE particles, and corrosion or adhesion of foreign substances with the pin holes as the nuclei will occur, which is related to irregularities in the charging.

Further, a nickel PTFE composite layer comprising PTFE particles with a diameter of 1 μm does not give rise to coarse secondary aggregates, and a layer where the PTFE particles are uniformly dispersed can be obtained. On the other hand, for a nickel PTFE composite layer comprising PTFE particles with a particle diameter of 0.2 μm, coarse secondary aggregates of the PTFE occur which exert an adverse effect on the corona discharge performance of the discharge electrode 610, and the dispersion state becomes non-uniform. As a result, pin holes will occur due to lacuna of the secondary aggregates from the nickel PTFE composite layer surface. Corrosion and adhesion of foreign substances with the pin holes as nuclei will occur, which become the cause of irregularities in the charging. From the above, the particle diameter of the PTFE is preferably 0.7 μm or above.

On the other hand, if substantially exceeding 20 μm, there is concern that exfoliation of the nickel PTFE composite layer may readily occur as a result of stress. The PTFE content of the plating bath is not particularly limited, and is preferably 0.01 to 10 mass % of the plating bath total amount, more preferably 0.1 to 1.0 mass %. Such a plating bath is commercially available, and as specific examples, for example, Kaniflon-S (product name, manufactured by Japan Kanigen Co., Ltd.), Nimuflon (product name, manufactured by C. Uyemura & Co., Ltd.), and Top Nickosite (product name, manufactured by Okuno Chemical Industries Co., Ltd.) may be mentioned. By immersing the needle shaped electrode substrate having a nickel layer formed on its surface in such a plating bath, at a bath temperature of 80° C. or more (preferably 90° C. or more), and carrying out electroless plating, a nickel PTFE composite plating layer is formed on the surface of the substrate. By making the bath temperature of the plating bath 80° C. or more, is it possible to form a smooth surface on the surface of the plating layer with a reduction in surfaces with unevenness such as on the wall faces of limestone caves and a reduction in the formation of granular surfaces. If there is unevenness or granularity on the surface, foreign substances can adhere to the tips of the discharge electrode 610. These adhered substances consist of sheet pieces or the like made of synthetic resins (for example, polyethylene terephthalate or the like), and even when the discharge electrode surface is rubbed and scraped and cleaned with the later described cleaning members 630*a* and 630*b* they are not removed, and can give rise to poor charging. Accordingly, if the plating layer surface is made smooth, poor charging can be further prevented. Furthermore, objects adhered to a smooth surface can be easily removed by the cleaning members 630*a* and 630*b*.

The retaining member 620 is a member extending lengthwise in one direction in the same way as the discharge electrode 610, having a cross section in a direction orthogonal to the lengthwise direction being an inverted letter-T shape, and which retains the discharge electrode 610. The retaining member 620 is constituted, for example, of a synthetic resin. The discharge electrode 610 is screwed by screw members 621 at one side face of the projecting portion of the retaining member 620 in the vicinity of both end portions in the long direction of the discharge electrode 610.

The cleaning members 630*a* and 630*b* are provided to be moveable relative to the discharge electrode 610, and are plate shaped members which clean the surface of the discharge electrode 610 by scraping the discharge electrode 610 when moving. The cleaning members 630*a* and 630*b* have an approximately letter T shape in planar projection form, with a thickness t of 20 to 40 μm. If the thickness t is less than 20 μm, they are easily deformed when contacting the discharge electrode 610, however, the pressing force towards the discharge electrode 610 which is a counter force accompanying the deformation weakens, whereby it is not possible to sufficiently remove contaminant substances adhered to the discharge electrode 610. On the other hand, if the thickness t exceeds 40 μm, it is possible to sufficiently remove contaminant substances adhered to the discharge electrode 610, however, the hardness becomes high and the pressing force towards the discharge electrode 610 becomes excessively strong, whereby there is concern of deformation and damage to the tips of the protruding portions 612 of the discharge electrode 610.

As a result, if the thickness t of the cleaning members 630*a* and 630*b* is outside the range of 20 to 40 μm, there is the possibility that image irregularities may occur due to poor charging. The cleaning members 630*a* and 630*b* are constituted, for example, of a metal material having elasticity, such as phosphor bronze, common steel, stainless steel and the like. Among these, in consideration of the use in an ozone atmosphere generated by the corona discharge, and from the viewpoint of long lifespan based on resistance to oxidation, the cleaning members 630*a* and 630*b* are preferably stainless steel. The stainless steel is not particularly limited, but is preferably SUS304 which is an austenitic stainless steel, or SUS430 which is a ferritic stainless steel, stipulated by G4305 of the Japan Industrial Standards Committee (JIS), or the like.

The hardness of the cleaning members 630*a* and 630*b* is preferably 115 or more on the Rockwell hardness M scale stipulated by the American Society for Testing and Materials (ASTM) standard D785. If the Rockwell hardness is less than 115, there is excessive softness, and therefore when contacting the discharge electrode 610 and scraping, the cleaning members 630*a* and 630*b* will deform beyond what is required and effective cleaning will not be obtained. The upper limit of the hardness of the cleaning members 630*a* and 630*b* is 130, because ASTM standard D785 sets an upper limit of 130. The width measurement w of the vertical portion of the letter T which is the portion which contacts the discharge electrode 610 of the cleaning members 630*a* and 630*b*, namely the width measurement w of the cleaning members 630*a* and 630*b* in the orthogonal direction with respect to the direction in which the protruding portions 612 extend and orthogonal to the direction of movement of the cleaning members 630*a* and 630*b*, is preferably 3.5 mm or more, and more preferably 3.5 to 10 mm from the viewpoint of longevity. If the width measurement w is less than 3.5 mm, the value of the force per unit area arising when pressing the discharge electrode 610 and deforming becomes large and therefore, fatigue failure by repeated deformation readily occurs, and the longevity is reduced.

Further, in addition to increasing the longevity, also from the viewpoint of preventing an increase in the size of the device, an upper limit of the width measurement w of 10 mm is preferable. Further, the cleaning members 630*a* and 630*b* and the discharge electrode 610 are preferably disposed such that the amount of bite d of the protruding portion 612 of the discharge electrode 610 with respect to the cleaning members 630*a* and 630*b* is 0.2 to 0.8 mm. Herein, the bite d means the length of the overlap of the cleaning members 630*a* and 630*b* and the protruding portion 612 in the direction of extension of the protruding portion 612, in a state where the cleaning members 630*a* and 630*b* and the protruding portion 612 are projected onto an imaginary plane orthogonal to the direction of relative movement of the cleaning members 630*a* and 630*b* with respect to the discharge electrode 610. If the bite d is less than 0.2 mm, the pressing force with respect to the discharge electrode 610 which is the counter force accompanying the deformation of the cleaning members 630*a* and 630*b* becomes weak, and contaminant matter adhering to the discharge electrode 610 cannot be sufficiently removed, and therefore, there is concern that charging irregularities may arise. If the bite d exceeds 0.8 mm, it is possible to remove contaminant matter adhering to the discharge electrode 610, but the counter force accompanying the deformation of the cleaning members 630*a* and 630*b* (the pressing force with respect to the discharge electrode 610) becomes excessively strong and therefore, the tips of the protruding portions 612 of the discharge electrode 610 may be deformed and damaged, and there is concern that charging irregularities may arise.

The support member 640 is a member having the form of an inverted letter L shape which supports the cleaning members 630*a* and 630*b*, and at its beam shaped portion, the arm portions of the cleaning members 630*a* and 630*b* having a letter T shape are mounted. The two cleaning members 630*a* and 630*b* are provided so as to have an interval L3 determined in advance in relation to the direction of relative movement with respect to the discharge electrode 610. The interval L3 is selected as a distance such that when one cleaning member 630*a* contacts the discharge electrode 610 and is deformed, the other cleaning members 630*b* does not touch the cleaning member 630*a* which is deformed, and can adjusted by the thickness of the beam shaped portion of the support member 640 to which it is mounted. The deformed state vary according to the material constituting the cleaning members 630*a* and 630*b*, therefore the interval L3 is desirably set by testing in advance the deformed state of the material. For example when the cleaning members 630*a* and 630*b* are made of stainless steel with a thickness t of 30 μm, the interval L3 of is preferably 2 mm. By providing an interval L3 of the two cleaning members 630*a* and 630*b*, while one cleaning member 630*a* is scraping the discharge electrode 610, it is possible to maintain a pressing force within a suitable range without hindering the deformation by the other cleaning member 630*b*, and therefore, it is possible to sufficiently clean the protruding portion 612 of the discharge electrode 610 without deformation damage.

The movement member 650 is provided to be inserted through the through hole 641 formed parallel to the direction of extension of the discharge electrode 610 in the pillar shaped portion of the support member 640. The movement member 650 is fixed at the support member 640 at the position of insertion through the through hole 641, and therefore, by pulling the movement member 650 in the direction of extension of the discharge electrode 610, the support member 640 slides with respect to the groove portion 601, and further is guided by the groove portion 601 and moves in the direction of extension of the discharge electrode 610. Namely, the cleaning members 630*a* and 630*b* supported by the support member 640 can contact and scrape the discharge electrode. The movement member 650 is a member which has a thread shape or wire shape, and extends outwards of the shield case 660 from a hole or opening formed in the shield case 660, and the ends thereof hang from pulleys 602*a*, 602*b* provided at the outer face of the shield case 660 or device body of the printer 100.

Further, FIG. 4 does not show portions of the movement member 650 other than the portions in the environ of the support member 640, in the environ of the pulley 602*a* and in the environ of the pulley 602*b*. The end portions of the movement member 650 preferably extend outwards of the device body of the printer 100 where the charging device 311Y is mounted. In this way, it is possible to implement cleaning of the discharge electrode 610 without detaching the charging device 311Y from the printer 100 or opening the printer 100. When the cleaning members 630*a* and 630*b* contact and clean the discharge electrode 610 by the pull of the movement member 650, the pressing force of the cleaning members 630*a* and 630*b* towards the discharge electrode 610 is preferably adjusted to be 10 to 30 gf. If the pressing force is less than 10 gf, there is concern that contaminant matter such as toner, paper dust or the like adhered to the discharge electrode 610 cannot be sufficiently removed, and if it exceeds 30 gf, there is concern that the tips of the protruding portions 612 of the discharge electrode 610 will be deformed and damaged.

The pressing force of the cleaning members 630*a* and 630*b* with respect to the discharge electrode 610 can be adjusted as follows, for example. In a state where a weight is suspended at one end portion of the movement member 650, the size of the force loaded on the cleaning member 630*a* or the cleaning member 630*b* is measured. The measurement, for example, is carried out connecting a spring scale to the cleaning member 630*a* or the cleaning member 630*b*. Then, the weight at which the force loaded on the cleaning member 630*a* or the cleaning member 630*b* is 10 to 30 gf is selected, and when cleaning the discharge electrode 610, by suspending the previously set weight at the end portion of the movement member 650, it is possible to clean with the prescribed pressing force. Further, it is also possible to load the prescribed pressing force by connecting an electromotor with an adjusted rotational torque at the end portion of the movement member 650.

The shield case 660 has an opening portion formed such that the face facing the surface of the photosensitive drum 310Y is open, and is a container shaped member with an approximately rectangular solid shape having an inner space formed by side walls 661, and a face (bottom face 662) opposite the face facing the surface of the photosensitive drum 310Y. The inner space of the shield case 660 accommodates the discharge electrode 610, the retaining member 620, the cleaning members 630*a* and 630*b*, and the support member 640. Further, the shield case 660 extends lengthwise in the same direction as the discharge electrode 610, and its cross sectional form in the direction orthogonal to the long direction is formed approximately as a letter U shape. The retaining member 620 is mounted at the bottom face 662 of the shield case 660. Further, at the groove portion 601 formed by the side wall 661 of the shield case 660 and the retaining member 620, the end portion of the pillar shaped portion of the support member 640 is slidably inserted. The shield case 660 is constituted, for example, of stainless steel or the like.

An insulating layer or semiconductive layer may be formed on one portion or the entire face of the inner wall face of the shield case 660. As an insulating material for forming the insulating layer, one usually used in the field may be used. Further, for the semiconductive layer, one having a sheet resistance of the fifth power of ten to the thirteenth power of ten Ω/□ is preferable, for example, a layer consisting of a resin composition comprising a synthetic resin and carbon black, or a layer consisting of a complex of tin oxide and aluminum (Sn—Al—O), or the like may be used. The insulating layer may be formed by pasting a sheet consisting of a resin composition comprising an insulating material with an adhesive, by heat sealing this sheet, or by coating a coating material wherein a resin composition comprising an insulating material is dissolved or dispersed in a suitable solvent and heating. The semiconductive layer may be formed in the same way as the insulating layer, other than using a semiconductive material instead of the insulating material.

By forming an insulating layer or semiconductive layer on part of or all of the face of the inner wall face of the shield case 660, the discharge efficiency by the discharge electrode 610 is increased, and a uniform charging of the photosensitive drum surface is obtained with a smaller discharge current amount than for the case where these layers are not formed.

Further, the shield case may be formed with notched portions at portions close to the photosensitive drum 310Y of the side wall which are at the upstream side in the direction of rotation of the photosensitive drum 310. By forming the notched portions, it is possible to increase the discharge performance. The width of the notched portions is not particularly limited, but for example, in the case where the dimensions of a side wall of a side where notched portions are not formed and the bottom face are 15 mm, the notches may be 1 mm.

The grid electrode 670 is a porous plate shaped member provided between the discharge electrode 610 and the photosensitive drum 310Y, so as to extend in the same direction as the discharge electrode 610. The grid electrode 670 adjusts the dispersion of the charged state of the surface of the photosensitive drum 310Y, and make the charge potential uniform.

The grid electrode 670 is divided into a plurality of regions by approximately parallel boundaries in a direction (the axial direction of the photosensitive drum) approximately orthogonal to the direction of rotation of the photosensitive drum 310Y. In the present embodiments, as shown in FIG. 5(*a*), the grid electrode 670 is divided into an upstream region 671 located at the upstream side in the direction of rotation of the photosensitive drum 310Y, a midstream region 672 located at the downstream side of the upstream region 671, and a downstream region 673 located at the downstream side of the midstream region 672, and the upstream region 671, midstream region 672, and the downstream region 673 are disposed in a metal frame 674.

Further, the midstream region 672 is arranged so as to be closest to the surface (photosensitive layer) of the photosensitive drum 310Y, and the upstream region 671 and the downstream region 673 are located at approximately the same distance with respect to the photosensitive drum 310Y.

Further, metal thin plates are arranged with a prescribed pitch at the upstream region 671, midstream region 672, and the downstream region 673, and by suitably varying the arrangement pitch (the interval between one metal thin plate and another metal thin plate neighboring the same in the long direction of the grid electrode 670; below referred to simply as the "arrangement pitch") of the metal thin plates and the width of the metal thin plates (the width of one metal thin plate in the long direction of the grid electrode 670; below referred to simply as the "metal thin plate width"), the opening ratio (%) can be adjusted. The opening ratio (%) refers to the value of the arrangement pitch divided by the total of the arrangement pitch and the metal thin plate width. Further, as the form of the holes, in the present embodiment they are in the form of a mesh, but for example, they may also be formed with a slit shape or a net shape.

Furthermore, the regions of the grid opening ratios are not limited to the three regions of upstream, midstream, and downstream, and for example, there may also be five regions (most upstream, upstream, midstream, downstream, and most downstream).

As shown in FIG. 5(*b*), the opening ratio of the midstream region 672 is formed so as to be larger than the opening ratios of the upstream region 671 and the downstream region 673. Namely, the opening ratios of the upstream region 671 and the downstream region 673 are formed so as to be smaller than the opening ratio of the midstream region 672. Further, the difference between the opening ratios of the midstream region 672 as compared to the upstream region 671 and the downstream region 673 is preferably 10 to 25%. Furthermore, the opening ratio of the upstream region 671 and the opening ratio of the downstream region 673 may be the same, but in the case that there is a difference in their size, the difference between the two is preferably within 10%.

The opening ratios of the upstream region 671, the midstream region 672, and the downstream region 673 may be suitably selected depending on the performance of the image forming apparatus, but for example, they are preferably selected from the ranges of 65 to 85% for the upstream region 671, 80 to 90% for the midstream region 672, and 65 to 85% for the downstream region 673. In the present embodiment, the opening ratio of the midstream region 672 is formed to be 90%, and opening ratios of the upstream region 671 and the downstream region 673 are formed so as to be 75% each.

Further, the grid electrode 670 is provided so as to be freely detachable from the charging device 311Y. The removal mechanism of the grid electrode 670 from the charging device 311Y is not particularly limited, and in the present embodiment, fitting holes 675*a* and 675*b* are formed at both end portions in the long direction of the grid electrode 670, and by fitting the fitting holes 675*a* and 675*b* at the support portions, not shown in the drawings, provided in the inner space of the shield case 660, the grid electrode 670 is removably attached to the charging device 311Y.

By dividing the grid electrode 670 into a plurality of regions having boundaries parallel to its long direction, and constituting it such that the opening ratio of the midstream region 672 which is close to the photosensitive drum 310Y is larger than the opening ratios of the upstream region 671 and the downstream region 673, and further, suitably adjusting the opening ratios of the upstream region 671, the midstream region 672, and the downstream region 673, it can be applied to various image forming apparatus with differing specifications with respect to image forming speed and the like. Namely, with the discharge electrode 311Y used as a platform, it is possible to select a grid electrode 670 meeting the specifications of the image forming apparatus.

Further, the grid electrode 670 is in electrical contact with the power source, not shown in the drawings, and this power source, not shown in the drawings, applies a voltage to the grid electrode 670 during the charging operation of charging the surface of the photosensitive drum 310Y. The grid electrode 670, for example, is constituted using the same metal material as the discharge electrode 610, and can be produced by masking and etching. It is preferable to form a nickel PTFE composite layer at least on a surface facing the photosensitive drum 310Y of the upstream region 671, the midstream region 672, and the downstream region 673 of the grid electrode 670. The nickel PTFE composite layer can be implemented in the same way as the formation of the nickel PTFE composite layer on the surface of the discharge electrode 610.

As explained above, for the charging device 311Y of the printer 100 according to the first embodiment, when a projection plane is defined as a plane including the grid electrode 670 to which the photosensitive drum 670 is projected, the grid electrode 670 is not divided into a plurality of regions where border lines are lines in a direction parallel to a projection line on the projection plane of a line along rotation direction of the photosensitive drum 670 (namely, not divided into a plurality of regions aligned along a line parallel to the rotation axis of the photosensitive drum 310Y), but the grid electrode 670 is divided into a plurality of regions where border lines are lines in a direction perpendicular to the projection line on the projection plane of the line along rotation direction of the photosensitive drum 670 (namely, is divided into a plurality of regions aligned along a line parallel to the projection line, i.e., along a line perpendicular to the rotation axis of the photosensitive drum 310Y). Then, the opening ratio of the midstream region 672, which is closest to the photosensitive drum 310Y, is made larger than the opening ratios of the upstream region 671 and the downstream region 673.

Therefore, the surface of the photosensitive drum 310Y, in addition to being exposed to a continuous discharge without interruptions from the beginning to the end time of charging, can also be exposed to the most discharge at the beginning of the charging by the midstream region 672 and be profusely charged, and after this, it is also possible to apply a charge to the portions where the charging is insufficient as a result of being exposed to a lesser discharge by charging by the upstream region 671 and the downstream region 673.

In this way, the surface of the photosensitive drum 310Y is constantly exposed to a discharge without interruption of the discharge before reaching an approximately uniformly charged state, therefore even though the discharge amount of the grid electrode 670 at the upstream side and the downstream side in the direction of rotation of the photosensitive drum 310 is reduced, it is possible to apply a charge to the portions where the charging is insufficient. Further, at the upstream side and downstream side in the direction of rotation of the photosensitive drum 310Y, the discharge amount can be reduced, and therefore it is possible to increase the performance of charging the surface of the photosensitive drum 310Y without increasing not only the discharge amount but also the discharge current amount.

As a result, it is possible to devise a reduction in size and increase in speed, while suppressing the occurrence of charging irregularities of the photosensitive drum surface. For example, even when used for a printer carrying out high speed image formation with a process speed on the order of 320 to 375 mm/sec (below referred to as "high speed device"), it is possible to suitably charge the photosensitive drum 310Y.

In particular, by making the opening ratio of the midstream region 672 which is closest to the photosensitive drum 310Y larger than the opening ratios of the upstream region 671 and the downstream region 673, it is possible to devise a further increase in charging performance in the charging device 311 while suppressing an increase in the discharge current amount, and a more uniform charging state of the surface of the photosensitive drum 310Y is implemented.

Further, in low speed devices of 320 mm/sec or less, a further improvement of the charging performance can be devised, and further reduction in size can also be devised.

Second Embodiment

Figure 6:
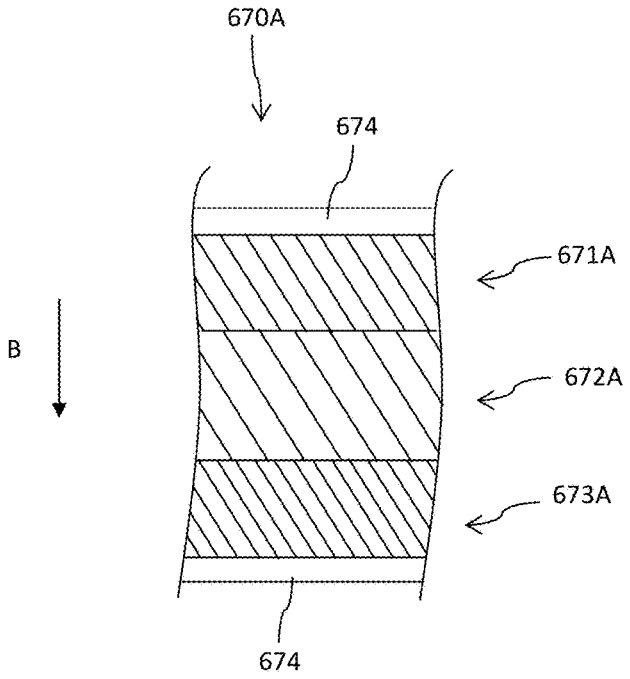
FIG. 6 is a drawing schematically showing a grid electrode according to the second embodiment.

Next, the printer 100A according to the second embodiment of the present invention is explained with reference to FIG. 6, with the aid of FIGS. 1 to 4. In the printer 100A according to the second embodiment the grid electrode of the charging device differs from that of the first embodiment. Therefore, herein, the explanation centers on the grid electrode, namely the point of difference with the first embodiment, and the constituents which are the same as for the first embodiment will have the same reference numbers as for the first embodiment and explanations thereof will be omitted. FIG. 6 is a drawing schematically showing the grid electrode 670 according to the second embodiment.

As shown in FIG. 6, the grid electrode 670A is divided into an upstream region 671A located at the upstream side in the direction of rotation of the photosensitive drum 310Y, a midstream region 672A located at the downstream side of the upstream region 671A, and a downstream region 673A located at the downstream side of the midstream region 672A, and the upstream region 671A, midstream region 672A, and downstream region 673A are provided inside the metal frame 674.

Further, the midstream region 672A is disposed to be the closest to the surface (photosensitive layer) of the photosensitive drum 310Y, and the upstream region 671A and the downstream region 673A are located at approximately the same distance with respect to the photosensitive drum 310Y.

Further, the opening ratio of the midstream region 672A is formed to be larger than the opening ratios of the upstream region 671A and the downstream region 673A, and the opening ratio of the upstream region 671A is formed to be larger than the opening ratio of the downstream region 673A.

As explained above, the grid electrode 670A of the printer 100A according to the second embodiment is formed such that the opening ratio of the midstream region 672A is larger than the opening ratios of the upstream region 671A and the downstream region 673A, and in addition the opening ratio of the upstream region 671A is larger than the opening ratio of the downstream region 673A.

Also in the case of such a constitution, even when the discharge amount of the grid electrode 670 of the upstream side and downstream side in the direction of rotation of the photosensitive drum 310Y is reduced, it is possible to apply a charge to the portions where the charging is insufficient. Further, the discharge amount of the upstream side and downstream side in the direction of rotation of the photosensitive drum 310Y can be reduced, and therefore it is possible to improve the performance of charging the surface of the photosensitive drum 310Y almost without increasing not only the discharge amount but also the discharge current amount.

Third Embodiment

Figure 7:
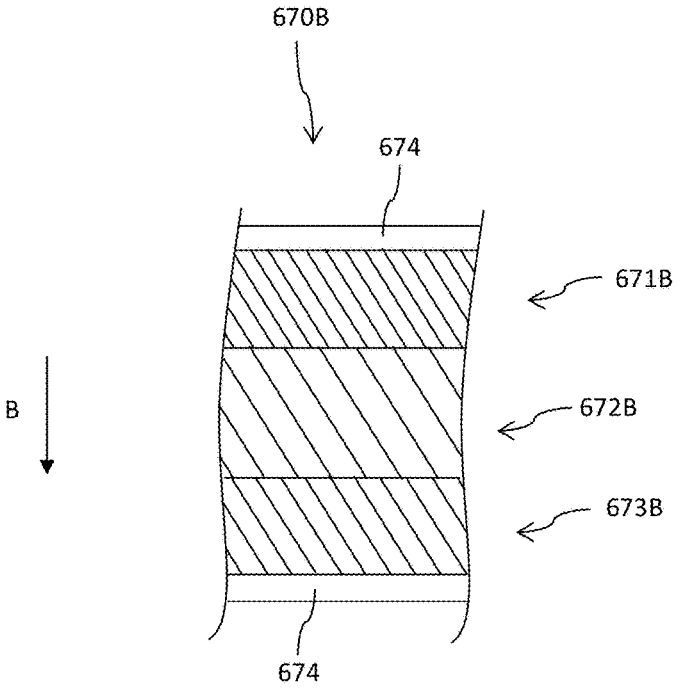
FIG. 7 is a drawing schematically showing a grid electrode according to the third embodiment.

Next, the printer 100B of the third embodiment according to the present invention is explained with reference to FIG. 7, with the aid of FIGS. 1 to 4. The printer 100B according to the third embodiment differs from the first embodiment in the grid electrode of the charging device. Therefore, herein, the explanation centers on the grid electrode, namely the point of difference with the first embodiment, and the constituents which are the same as for the first embodiment will have the same reference numbers as for the first embodiment and explanations thereof will be omitted. FIG. 7 is a drawing schematically showing a grid electrode according to the third embodiment.

As shown in FIG. 7, the grid electrode 670B is divided into an upstream region 671B located at the upstream side in the direction of rotation of the photosensitive drum 310Y, a midstream region 672B located at the downstream side of the upstream region 671B, and a downstream region 673B located at the downstream side of the midstream region 672B, and the upstream region 671B, midstream region 672B, and downstream region 673B are provided in the metal frame 674.

Further, the midstream region 672B is disposed so as to be the closest to the surface (photosensitive layer) of the photosensitive drum 310Y, and the upstream region 671B and the downstream region 673B are located approximately the same distance with respect to the photosensitive drum 310Y.

Further, the opening ratio of the midstream region 672B is greater than the opening ratios of the upstream region 671B and the downstream region 673B, and the opening ratio of the downstream region 673B is greater than the opening ratio of the upstream region 671B.

As explained above, the grid electrode 670B of the printer 100B according to the third embodiment is formed such that the opening ratio of the midstream region 672B is larger than the opening ratios of the upstream region 671B and the downstream region 673B, and in addition the opening ratio of the downstream region 673B is larger than the opening ratio of the downstream region 671B.

Also in the case of such a constitution, even when the discharge amount of the grid electrode 670 of the upstream side and downstream side in the direction of rotation of the photosensitive drum 310Y is reduced, it is possible to apply a charge to the portions where the charging is insufficient. Further, the discharge amount of the upstream side and downstream side in the direction of rotation of the photosensitive drum 310Y can be reduced, and therefore it is possible to improve the performance of charging the surface of the photosensitive drum 310Y almost without increasing not only the discharge amount but also the discharge current amount.

Fourth Embodiment

Figure 8:
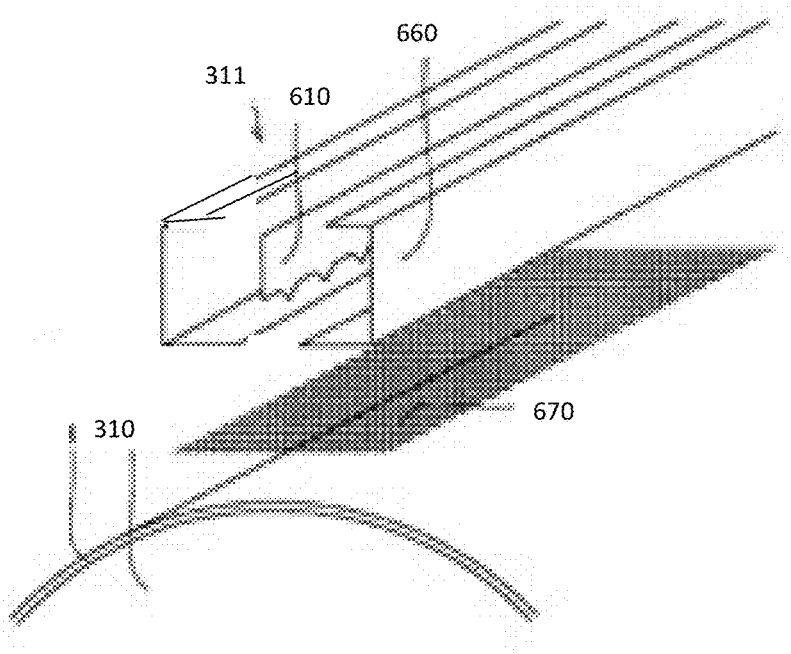
FIG. 8 is an oblique view showing a charging device according to the first to third embodiments of the present invention, and its environs.
Figure 9:
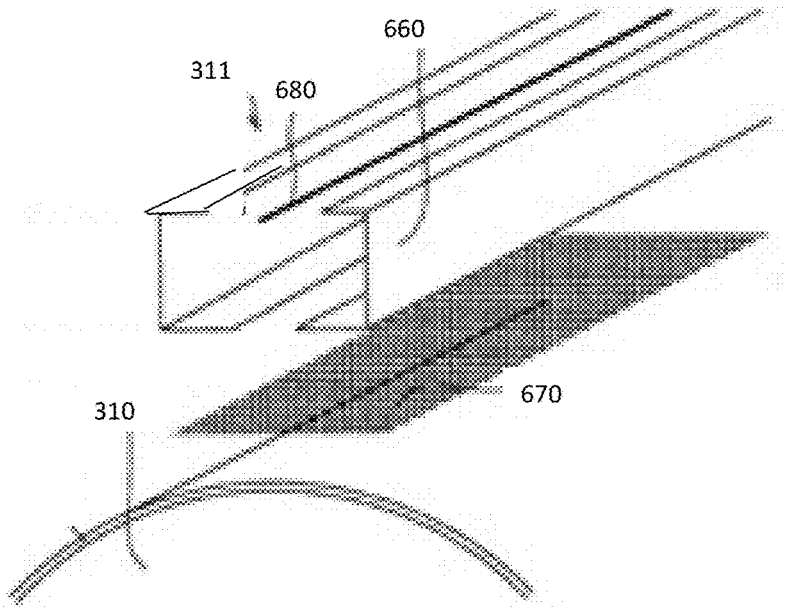
FIG. 9 is an oblique view showing a charging device and its environs according to the fourth embodiment of the present invention.

In the first to third embodiments, as shown in FIG. 8, a discharge electrode 610 with a sawtooth shape was used. In contrast, in the fourth embodiment, a wire shaped discharge electrode 680 as shown in FIG. 9 is used.

Fifth Embodiment

Figure 10:
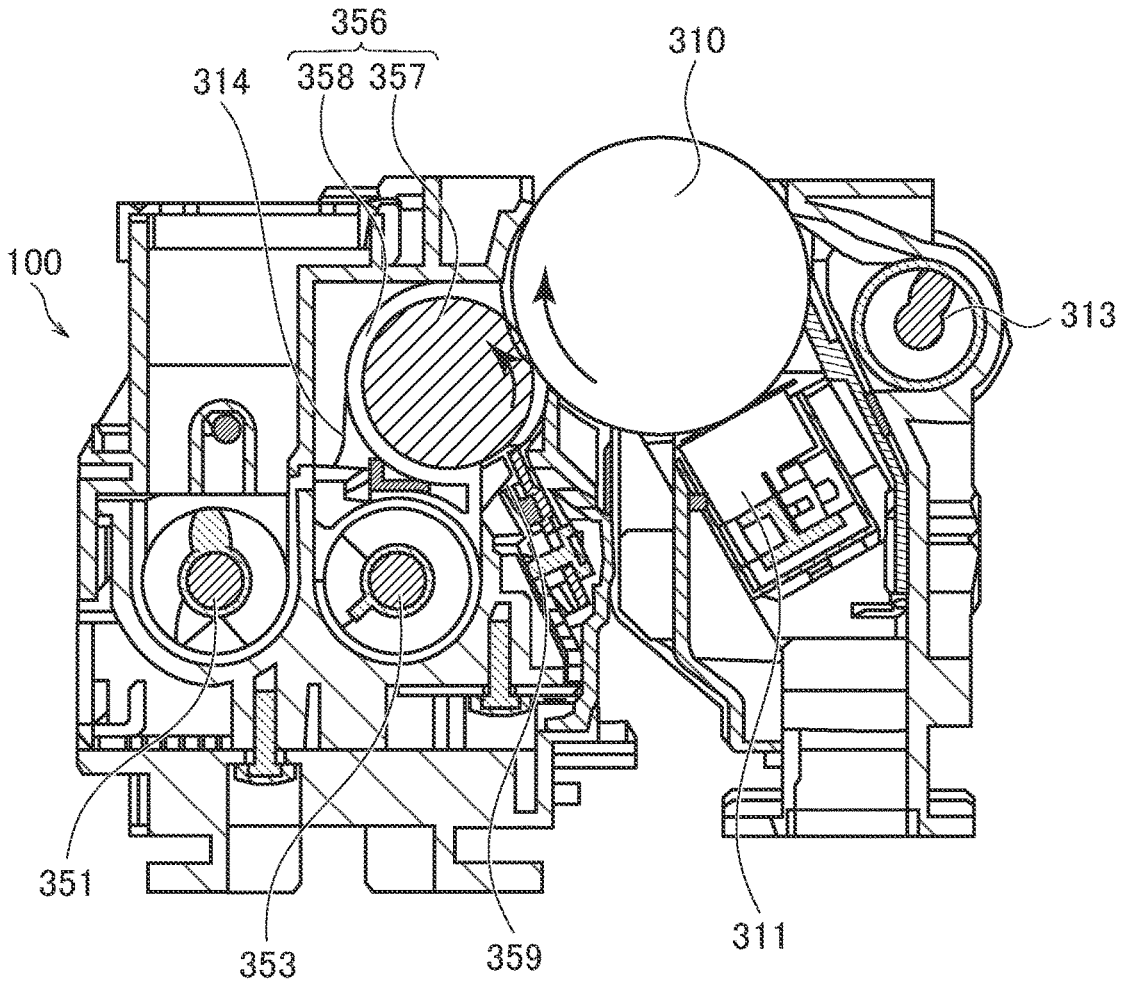
FIG. 10 is a cross sectional view schematically showing a process cartridge according to the fifth embodiment of the present invention.

In the fifth embodiment, an image forming apparatus having a cross sectional form as shown in the cross sectional drawing of FIG. 10 is used. The developing device main body 314 internally comprises two auger screws 351 and 353, a developing roll 356, and a developer layer thickness control member 359.

As shown in FIG. 10, one auger screw 351 of the two auger screws conveys while mixing the developing agent into the page, and the other auger screw 353 conveys while mixing the developing agent towards the forefront of the page. Further, the developer which has reached the outlet of the one auger screw 351 is conveyed to the inlet of the other auger screw 353, and in the same way, the developer which has reached the outlet of the other auger screw 353 is conveyed to the inlet of the one auger screw 351, whereby the developer is circulated inside the developing device main body 314. The developing roll 357 draws up the circulating developer, and the developer is conveyed onto a developing sleeve included in the developing roll 356, and is adhered to the photosensitive drum 310. The developer layer thickness control member 359 controls the layer thickness of the developer on the developing sleeve, and in this way, restricts the amount of toner adhering to the photosensitive drum 310.

In the constitution of an imaging unit such as shown in FIG. 10, the developer is consolidated by the developer layer thickness control member 359 whereby aggregates of the developer readily occur, the centrifugal force due to the rotation of the developing sleeve 358 becomes large with respect to the magnetic binding force of the magnetic roller 357 included in the developing roll 356, and the aggregated developer flies towards the charging unit 311 side once it has passed the developer layer thickness control member 359.

Further, because the sawtooth electrode 610 has a dust collecting effect, the aggregated developer which has flown from the developing unit 314 readily adheres to the grid electrode 670, and the developer soiling of the grid electrode 670 is promoted.

However, by constituting the charging device 311 using the grid electrode 670 of the present application, the developer soiling of the grid electrode 670 is suppressed, and in turn, the occurrence of the charging irregularities of the surface of the photosensitive drum 310 is suppressed, while making it possible to provide an imaging unit which can be reduced in size and increased in speed.

The embodiments of the present invention were explained above, but the present invention is not limited to the above described embodiments. Further, the effects disclosed in the embodiments of the present invention are merely listings of the most suitable effects arising from the present invention, and the effects of the present invention are not limited to those disclosed in the embodiments of the present invention.

For example, in the present embodiments, as the region closest to the photosensitive drum 310Y, an explanation was made for the case of using the midstream region 672, but the present invention is not limited to this. For example, the upstream region 671 may be taken as the closest region to the photosensitive drum 310Y. By such a constitution, even if the discharge amount of the grid electrode 670 of the midstream side and downstream side in the direction of rotation of the photosensitive drum 310Y is reduced, it is possible to impart a charge to the insufficiently charged portions. Further, the discharge amount of the midstream side and downstream side in the direction of rotation of the photosensitive drum 310Y may be reduced, and therefore, it is possible to improve the charging performance of the photosensitive drum 310Y without increasing not only the discharge amount but also the discharge electric current.

Further, for example, the downstream region 673 may be taken as the closest region to the photosensitive drum 310Y. By such a constitution, even if the discharge amount of the grid electrode 670 of the upstream side and midstream side in the direction of rotation of the photosensitive drum 310Y is reduced, it is possible to impart a charge to the insufficiently charged portions. Further, the discharge amount of the upstream side and midstream side in the direction of rotation of the photosensitive drum 310Y may be reduced, and therefore, it is possible to improve the charging performance of the photosensitive drum 310Y without increasing not only the discharge amount but also the discharge electric current.

In the present embodiments, as the discharge electrode, as shown in FIG. 8, a saw blade shaped metal having acutely shaped protruding portions is utilized, but as shown in FIG. 9, it is also possible to utilize a wire shaped metal. Further, the number of the wire shaped discharge electrodes is one in FIG. 9, but it may also be two or more.

Further, in an embodiment such as that shown in FIG. 10, it is possible to include the charging device inside an image forming apparatus.

EXAMPLES

Next, the present invention is specifically explained using Examples 1 to 10 and Comparative Examples 1 to 7.

Example 1

For the discharge electrode as shown in FIG. 8, metal with a saw blade shape having a plurality of acutely shaped protruding portions can be utilized as the discharge electrode.

A masking treatment and etching treatment were carried out on a metal plate (measurements 20 mm×310 mm×thickness 0.1 mm) consisting of stainless steel (SUS304), and the discharge electrode substrate was produced. Specifically, the etching was carried out by spraying a 30 mass % aqueous solution of iron (II) chloride at a temperature of 90° C. for 2 hours onto a stainless steel metal plate. After the etching, the discharge electrode substrate was removed from the etching fluid, washing with water and purified water was carried out, and the discharge electrode substrate was produced. A Ni plating layer with a layer thickness of 0.5 μm was formed by electroplating on the surface of this discharge electrode substrate.

Next, the discharge electrode substrate on which this Ni plating layer has been formed was immersed for 30 min in a nickel PTFE complex plating bath (bath temperature 90° C.) which had been subjected to a de-airing treatment (reduced pressure: 1/10 atmospheric pressure, de-airing time: 10 min) after PTFE particles with a particle diameter of 1 μm had been dispersed therein so as to make the PTFE particle content 18 vol %, and a discharge electrode having a nickel PTFE complex plating layer with a thickness of 6 μm formed on its surface as a finishing plating layer was produced. Further, as the nickel PTFE plating bath, Nimuflon (product name) manufactured by C. Uyemura & Co., Ltd., subjected to adjustment of the content of the PTFE particles and to de-airing treatment as described above was used as the plating bath. After the plating is completed, the discharge electrode was removed from the plating bath, washing with water and purified water was carried out, followed by drying and the discharge electrode was produced. Upon examining the surface of the formed nickel PTFE complex plating layer with a scanning electron microscope (product name: Real Surface View, manufactured by Keyence Corporation), secondary aggregates of PTFE particles were not observed and the PTFE particles were uniformly distributed, and pinholes were also not observed.

Next, a masking treatment and etching treatment were carried out for a metal plate (dimensions 20 mm×310 mm×thickness 0.1 mm) consisting of stainless steel (SUS304), and a grid electrode having an upstream region, midstream region, and downstream region in the form of a mesh, divided by borders approximately parallel to the long direction was produced.

The length in the width direction orthogonal to the long direction of the upstream region, midstream region, and downstream region was 4.0 mm for the upstream region, 5.0 mm for the midstream region, and 4.0 mm for the downstream region, and the distance from the photosensitive drum was 1.4 mm for the upstream region, 0.8 mm for the midstream region and 1.4 mm for the downstream region. Further, when this grid electrode was mounted on an electrophotographic type image forming apparatus, for the upstream region located at the upstream side in the direction of rotation of the photosensitive drum (most upstream side), the array pitch was 0.30 mm, the metal thin plate width was 0.1 mm, and the opening ratio was 75%. For the midstream region located at the downstream side adjacent to the upstream region, the array pitch was 0.90 mm, the metal thin plate width was 0.1 mm, and the opening ratio was 90%. For the downstream region located at the downstream side adjacent to the midstream region (most downstream side), the array pitch was 0.30 mm, the metal thin plate width was 0.1 mm, and the opening ratio was 90%.

Further, when the grid electrode was used in an electrophotographic type image forming apparatus, in the same way as described above, on the surface facing the photosensitive drum a Ni plating layer was formed with a thickness of 0.5 μm, and as a finishing layer, a nickel PTFE plating layer with a layer thickness of 3 μm was formed on the surface of the Ni plating layer by immersing for 15 min in a nickel PTFE composite plating bath (bath temperature 90° C.) wherein PTFE particles with a particle diameter of 1 μm were dispersed therein such that the PTFE particle content was 18 vol % and which had been subjected to a de-airing treatment. Upon examining the surface of the nickel PTFE composite plating layer with a scanning electron microscope (product name: Real Surface View, manufactured by Keyence Corporation), secondary aggregates of the PTFE particles were not observed, the PTFE particles were uniformly dispersed, and pinholes were not observed.

The discharge electrode and grid electrode obtained as described above were exchanged for the discharge electrode and grid electrode of a charging device in a commercially available image forming apparatus (product name: MX3500, manufactured by Canon Inc.) evaluation device modified as a high speed device having process speeds of 320 to 375 mm/sec. Using this image forming apparatus, a halftone image was duplicated, and the charging performance at this time was measured, and observation by eye of the obtained halftone image was carried out. The evaluation criteria for the charging performance were as follows. ◎: Excellent; ○: Good; Δ: Acceptable; x: Poor Further, the evaluation criteria for the image uniformity were as follows. ○: image irregularities were not noted by eye; Δ: portions thought to have small image irregularities were discerned; x: image irregularities such as whiteout, blackout and the like were discerned on part of the image. The criteria for the overall evaluation were as follows. ◎: Excellent; ○: Good; Δ: Acceptable x: Poor The evaluation results are shown in Table 1.

Example 2

The same discharge electrode as in Example 1 was produced. Further, in the same way as in Example 1, a grid electrode was produced having an upstream region where the array pitch was 0.19 mm, the metal thin plate width was 0.1 mm, and the opening ratio was 65%, a midstream region where the array pitch was 0.90 mm, the metal thin plate width was 0.1 mm, and the opening ratio was 90%, and a downstream region where the array pitch was 0.19 mm, the metal thin plate width was 0.1 mm, and the opening ratio was 65%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 3

The discharge electrode was produced in the same way as in Example 1. Further, in the same way as in Example 1, a grid electrode was produced having an upstream region where the array pitch was 0.30 mm, the metal thin plate width was 0.1 mm, and the opening ratio was 75%, a midstream region where the array pitch was 0.57 mm, the metal thin plate width was 0.1 mm, and the opening ratio was 85%, and a downstream region where the array pitch was 0.30 mm, the metal thin plate width was 0.1 mm, and the opening ratio was 75%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 4

The discharge electrode was produced in the same way as in Example 1. Further, in the same way as in Example 1, a grid electrode was produced having an upstream region where the array pitch was 0.40 mm, the metal thin plate width was 0.1 mm, and the opening ratio was 80%, a midstream region where the array pitch was 0.90 mm, the metal thin plate width was 0.1 mm, and the opening ratio was 90%, and a downstream region where the array pitch was 0.23 mm, the metal thin plate width was 0.1 mm, and the opening ratio was 70%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 5

The discharge electrode was produced in the same way as in Example 1. Further, in the same way as in Example 1, a grid electrode was produced having an upstream region where the array pitch was 0.23 mm, the metal thin plate width was 0.1 mm, and the opening ratio was 70%, a midstream region where the array pitch was 0.90 mm, the metal thin plate width was 0.1 mm, and the opening ratio was 90%, and a downstream region where the array pitch was 0.40 mm, the metal thin plate width was 0.1 mm, and the opening ratio was 80%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 6

The discharge electrode was produced in the same way as in Example 1. Further, in the same way as in Example 1, a grid electrode was produced having an upstream region where the array pitch was 0.30 mm, the metal thin plate width was 0.1 mm, and the opening ratio was 75%, a midstream region where the array pitch was 0.90 mm, the metal thin plate width was 0.1 mm, and the opening ratio was 90%, and a downstream region where the array pitch was 0.30 mm, the metal thin plate width was 0.1 mm, and the opening ratio was 75%. The lengths in the width direction orthogonal to the long direction of the upstream region, midstream region, and downstream region of this grid electrode were 5.0 mm for the upstream region, 3.0 mm for the midstream region, and 5.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 7

The discharge electrode was produced in the same way as in Example 1. Further, in the same way as in Example 1, a grid electrode was produced having an upstream region where the array pitch was 0.30 mm, the metal thin plate width was 0.1 mm, and the opening ratio was 75%, a midstream region where the array pitch was 0.90 mm, the metal thin plate width was 0.1 mm, and the opening ratio was 90%, and a downstream region where the array pitch was 0.30 mm, the metal thin plate width was 0.1 mm, and the opening ratio was 75%. The lengths in the width direction orthogonal to the long direction of the upstream region, midstream region, and downstream region of this grid electrode were 4.5 mm for the upstream region, 4.0 mm for the midstream region, and 4.5 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Example 8

The discharge electrode was produced in the same way as in Example 1. Further, in the same way as in Example 1, a grid electrode was produced having an upstream region where the array pitch was 0.90 mm, the metal thin plate width was 0.1 mm, and the opening ratio was 90%, a midstream region where the array pitch was 0.40 mm, the metal thin plate width was 0.1 mm, and the opening ratio was 80%, and a downstream region where the array pitch was 0.23 mm, the metal thin plate width was 0.1 mm, and the opening ratio was 70%. The lengths in the width direction orthogonal to the long direction of the upstream region, midstream region, and downstream region of this grid electrode were 3.0 mm for the upstream region, 4.0 mm for the midstream region, and 5.0 mm for the downstream region, and the distances from the photosensitive drum were 0.8 mm for the upstream region, 1.1 mm for the midstream region, and 1.4 mm for the downstream region.

Using this discharge electrode and grid electrode, the measurements and evaluation by eye were carried out in the same way as in Example 1. The results are shown in Table 1.

Example 9

The discharge electrode was produced in the same way as in Example 1. Further, in the same way as in Example 1, a grid electrode was produced having an upstream region where the array pitch was 0.23 mm, the metal thin plate width was 0.1 mm, and the opening ratio was 70%, a midstream region where the array pitch was 0.40 mm, the metal thin plate width was 0.1 mm, and the opening ratio was 80%, and a downstream region where the array pitch was 0.90 mm, the metal thin plate width was 0.1 mm, and the opening ratio was 90%. The lengths in the width direction orthogonal to the long direction of the upstream region, midstream region, and downstream region of this grid electrode were 5.0 mm for the upstream region, 4.0 mm for the midstream region, and 3.0 mm for the downstream region, and the distances from the photosensitive drum were 1.4 mm for the upstream region, 1.1 mm for the midstream region, and 0.8 mm for the downstream region.

Using this discharge electrode and grid electrode, the measurements and evaluation by eye were carried out in the same way as in Example 1. The results are shown in Table 1.

Example 10

Example 10 uses the same grid electrode as Example 1. In Example 1, as the discharge electrode, one with a saw blade shape having a plurality of tip-shaped protruding portions was used, in contrast, Example 10 differs from Example 1 in the point of using one having a wire shape.

For the discharge electrode, as shown in FIG. 9, a wire (charge wire) spanning the axial direction of the photosensitive body is adopted as the discharge electrode. The material of this wire may be any metal as long as it is a metal, for example, here it is tungsten. For the thickness of the wire adopted as the discharge electrode, the diameter is preferably 30 to 100 μm. Making the diameter no less than this lower limit value has the advantage that it is possible to keep the mechanical strength of the electrode; and making the diameter no more than this upper limit value has the advantage that it is possible to increase the efficiency of the discharge with a concentrated electric field. For example, here the diameter is 50 μm.

Furthermore, it is possible to design for prevention of contamination by applying a plating to the charge wire.

Furthermore, the charge wire is not limited to one, and a plurality thereof may be used.

Using this charge wire and the same grid electrode as in Example 1, evaluations by measurement and eye were carried out in the same way as in Example 1. The results are shown in Table 1.

Comparative Example 1

The same discharge electrode as in Example 1 was produced. Further, in the same way as in Example 1, a grid electrode was produced having an upstream region where the array pitch was 0.57 mm, the metal thin plate width was 0.1 mm, and the opening ratio was 85%, a midstream region where the array pitch was 0.23 mm, the metal thin plate width was 0.1 mm, and the opening ratio was 70%, and a downstream region where the array pitch was 0.57 mm, the metal thin plate width was 0.1 mm, and the opening ratio was 85%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 2

The same discharge electrode as in Example 1 was produced. Further, in the same way as in Example 1, a grid electrode was produced having an upstream region where the array pitch was 0.23 mm, the metal thin plate width was 0.1 mm, and the opening ratio was 70%, a midstream region where the array pitch was 0.40 mm, the metal thin plate width was 0.1 mm, and the opening ratio was 80%, and a downstream region where the array pitch was 0.90 mm, the metal thin plate width was 0.1 mm, and the opening ratio was 90%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 3

The discharge electrode was produced in the same way as in Example 1. Further, in the same way as in Example 1, a grid electrode was produced having an upstream region where the array pitch was 0.90 mm, the metal thin plate width was 0.1 mm, and the opening ratio was 90%, a midstream region where the array pitch was 0.40 mm, the metal thin plate width was 0.1 mm, and the opening ratio was 80%, and a downstream region where the array pitch was 0.23 mm, the metal thin plate width was 0.1 mm, and the opening ratio was 70%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 4

The discharge electrode was produced in the same way as in Example 1. Further, in the same way as in Example 1, a grid electrode was produced having an upstream region, a midstream region, and a downstream region where the array pitch was 0.40 mm, the metal thin plate width was 0.1 mm, and the opening ratio was 80%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 5

The discharge electrode was produced in the same way as in Example 1. Further, in the same way as in Example 1, a grid electrode was produced having an upstream region, a midstream region, and a downstream region where the array pitch was 0.30 mm, the metal thin plate width was 1.1 mm, and the opening ratio was 75%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 6

The discharge electrode was produced in the same way as in Example 1. Further, in the same way as in Example 1, a grid electrode was produced having an upstream region, a midstream region, and a downstream region where the array pitch was 0.90 mm, the metal thin plate width was 2.1 mm, and the opening ratio was 90%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

Comparative Example 7

Comparative Example 7 uses the same grid electrode as in Comparative Example 1. In Comparative Example 1, as the discharge electrode, one with a saw blade shape having a plurality of acutely shaped protruding portions was used, in contrast, Comparative Example 7 differs from Comparative Example 1 in the point of using one which is wire shaped.

A wire discharge electrode the same as that of Example 7 was produced. Further, in the same way as in Example 10, a grid electrode was produced having an upstream region where the array pitch was 0.57 mm, the metal thin plate width was 0.1 mm, and the opening ratio was 85%, a midstream region where the array pitch was 0.23 mm, the metal thin plate width was 0.1 mm, and the opening ratio was 70%, and a downstream region where the array pitch was 0.57 mm, the metal thin plate width was 0.1 mm, and the opening ratio was 85%. The lengths in the width direction orthogonal to the long direction of the upstream region, midstream region, and downstream region of this grid electrode were 4.0 mm for the upstream region, 5.0 mm for the midstream region, and 4.0 mm for the downstream region, and the distances from the photosensitive drum were 1.4 mm for the upstream region, 0.8 mm for the midstream region, and 1.4 mm for the downstream region.

Using this discharge electrode and grid electrode, the measurements and evaluation by eye were carried out in the same way as in Example 1. The results are shown in Table 1.

TABLE 1

| | opening ratio (%) | | | region width (mm) | | | distance from photosensitive drum | | | evaluation | | | |
|---|---|---|---|---|---|---|---|---|---|---|---|---|---|
| | up-stream | mid-stream | down-stream | up-stream | mid-stream | down-stream | up-stream | mid-stream | down-stream | charging performance | image uniformity | overall evaluation | form |
| Example 1 | 75 | 90 | 75 | 4.0 | 5.0 | 4.0 | 1.4 mm | 0.8 mm | 1.4 mm | ◎ | ○ | ◎ | sawtooth |
| Example 2 | 65 | 90 | 65 | 4.0 | 5.0 | 4.0 | 1.4 mm | 0.8 mm | 1.4 mm | ○ | ○ | ○ | sawtooth |
| Example 3 | 75 | 85 | 75 | 4.0 | 5.0 | 4.0 | 1.4 mm | 0.8 mm | 1.4 mm | ○ | ○ | ○ | sawtooth |
| Example 4 | 80 | 90 | 70 | 4.0 | 5.0 | 4.0 | 1.4 mm | 0.8 mm | 1.4 mm | ◎ | ○ | ◎ | sawtooth |
| Example 5 | 70 | 90 | 80 | 4.0 | 5.0 | 4.0 | 1.4 mm | 0.8 mm | 1.4 mm | ◎ | ○ | ◎ | sawtooth |
| Example 6 | 75 | 90 | 75 | 5.0 | 3.0 | 5.0 | 1.4 mm | 0.8 mm | 1.4 mm | ◎ | ○ | ◎ | sawtooth |
| Example 7 | 75 | 90 | 75 | 4.5 | 4.0 | 4.5 | 1.4 mm | 0.8 mm | 1.4 mm | ◎ | ○ | ◎ | sawtooth |
| Example 8 | 90 | 80 | 70 | 3.0 | 4.0 | 5.0 | 0.8 mm | 1.1 mm | 1.4 mm | ○ | ○ | ○ | sawtooth |
| Example 9 | 70 | 80 | 90 | 5.0 | 4.0 | 3.0 | 1.4 mm | 1.1 mm | 0.8 mm | ○ | ○ | ○ | sawtooth |
| Example 10 | 75 | 90 | 75 | 4.0 | 5.0 | 4.0 | 1.4 mm | 0.8 mm | 1.4 mm | ◎ | ○ | ◎ | wire |
| Comparative Example 1 | 85 | 70 | 85 | 4.0 | 5.0 | 4.0 | 1.4 mm | 0.8 mm | 1.4 mm | X | X | X | sawtooth |
| Comparative Example 2 | 70 | 80 | 90 | 4.0 | 5.0 | 4.0 | 1.4 mm | 0.8 mm | 1.4 mm | ○ | Δ | Δ | sawtooth |
| Comparative Example 3 | 90 | 80 | 70 | 4.0 | 5.0 | 4.0 | 1.4 mm | 0.8 mm | 1.4 mm | ○ | Δ | Δ | sawtooth |
| Comparative Example 4 | | 80 | | 4.0 | 5.0 | 4.0 | 1.4 mm | 0.8 mm | 1.4 mm | ○ | Δ | Δ | sawtooth |

TABLE 1-continued

| | opening ratio (%) | | | region width (mm) | | | distance from photosensitive drum | | | evaluation | | | |
|---|---|---|---|---|---|---|---|---|---|---|---|---|---|
| | up-stream | mid-stream | down-stream | up-stream | mid-stream | down-stream | up-stream | mid-stream | down-stream | charging performance | image uniformity | overall evaluation | form |
| Comparative Example 5 | | 75 | | 4.0 | 5.0 | 4.0 | 1.4 mm | 0.8 mm | 1.4 mm | X | ○ | X | sawtooth |
| Comparative Example 6 | | 90 | | 4.0 | 5.0 | 4.0 | 1.4 mm | 0.8 mm | 1.4 mm | ◎ | X | X | sawtooth |
| Comparative Example 7 | 85 | 70 | 85 | 4.0 | 5.0 | 4.0 | 1.4 mm | 0.8 mm | 1.4 mm | X | X | X | wire |

CONCLUSIONS

In Examples 1 to 7, the distance between the midstream grid electrode and the photosensitive drum is set so as to be shorter than the distance between the upstream grid electrode and the photosensitive drum, and the distance between the downstream grid electrode and the photosensitive drum. Further, the distance between the upstream grid electrode and the photosensitive drum is equal to the distance between the downstream grid electrode and the photosensitive drum. This indicates that, when viewed in the short direction of the charging device, the charging device is disposed such that the center of the charging device is closest to the photosensitive drum. Further, the opening ratio of the midstream grid electrode is higher than the opening ratio of the upstream grid electrode and the opening ratio of the downstream grid electrode. In these examples, results of "excellent" or "good" were obtained for the charging performance and the image uniformity.

In Example 8, the distance between the upstream grid electrode and the photosensitive drum was set shorter than the distance between the midstream grid electrode and the photosensitive drum, and the distance between the midstream grid electrode and the photosensitive drum was set shorter than the distance between the downstream grid electrode and the photosensitive drum. This indicates that, when viewed in the short direction of the charging device, the charging device is disposed such that the upstream side is closer than the center of the charging device to the photosensitive drum. Further, the opening ratio of the upstream grid electrode is higher than the opening ratio of the midstream grid electrode and the opening ratio of the midstream grid electrode is higher than the opening ratio of the downstream grid electrode. In this example, the charging performance and the image uniformity obtained an evaluation of "good".

In Example 9, compared to Example 8, the upstream side and downstream side are exchanged. Also in this example, the charging performance and the image uniformity obtained an evaluation of "good".

Example 10, as described above, uses the same grid electrode as Example 1. In Example 1, as the discharge electrode, a saw blade shape having a plurality of acutely shaped protruding portions is used, in contrast, Example 10 differs from Example 1 in the point that one having a wire shape is used. In Example 10 the results for the charging performance and the image uniformity were the same as for Example 1.

The difference between whether the discharge electrode is saw blade shaped or wire shaped gives rise to a difference in the shape when viewed in the long direction of the charging device, but gives rise to almost no difference in the shape when viewed in the short direction of the charging device. Further, in Examples 1 to 9, when viewed in the short direction of the charging device the numerical values are changed, and Examples 1 to 9, in the case of viewing in the long direction, there is no difference. Accordingly, if it is the case that the results for the charging performance and the image uniformity are the same in Example 1 and Example 10, compared to Examples 2 to 9, if examples would be provided which differ only in the point of changing the discharge electrode from a saw blade shape to a wire shape, it could be expected that these examples would provide the same results as the respective Examples 2 to 9. Accordingly, Examples 11 to 18 corresponding to Examples 2 to 9 are omitted.

In Comparative Examples 1 to 3, in the same way as in Examples 1 to 5, the distance between the midstream grid electrode and the photosensitive drum is set to be shorter than the distance between the upstream grid electrode and the photosensitive drum and the distance between the downstream grid electrode and the photosensitive drum. Further, in Comparative Examples 1 to 3, in the same way as in Examples 1 to 5, the distance between the upstream grid and the photosensitive drum was equal to the distance between the downstream grid and the photosensitive drum. This indicates that, when viewed in the short direction of the charging device, the charging device is disposed such that the center of the charging device is closest to the photosensitive drum. Further, in Comparative Examples 1 to 3, unlike Examples 1 to 5, the opening ratio of the midstream grid electrode is lower than the opening ratio of the upstream grid electrode and the downstream grid electrode. In these comparative examples, the obtained results for at least one of the charging performance and the image uniformity remained at "poor" or "acceptable".

In Comparative Examples 4 to 6, unlike Examples 1 to 10 and Comparative Examples 1 to 3, the opening ratio of the grid electrode was the same for the upstream, midstream, and downstream. In these comparative examples, the obtained results for at least one of the charging performance and the image uniformity remained at "poor" or "acceptable".

Comparative Example 7, as described above, is one using the same grid electrode as Comparative Example 1. In Comparative Example 1, as the discharge electrode, one with a saw blade shape having a plurality of acutely shaped protruding portions was used, in contrast, Comparative Example 7 differs from Comparative Example 1 in the point that Comparative Example 7 uses one having a wire shape. In Comparative Example 7 the results for the charging performance and image uniformity were the same as Comparative Example 1.

Accordingly, if it is the case that the results for the charging performance and the image uniformity are the same in Example 1 and Example 10, compared to Examples 2 to 9, if examples would be provided which differ only in the point of changing the discharge electrode from a saw blade shape to a wire shape, it could be expected that these examples would provide the same results as the respective Examples 2 to 9, and the same reason can be applied to Comparative Examples 1 to 6. Accordingly, Comparative Examples 8 to 12 corresponding to Comparative Examples 2 to 6 are omitted.

From Examples 1 to 10 and Comparative Examples 1 to 7, it could be confirmed that regardless of whether the form of the discharge electrode is a saw blade shape or a wire shape, by selecting as the grid electrode one which is divided into a plurality of regions in a direction along the direction of rotation of the photosensitive drum, and setting the plurality of regions such that an opening ratio of a region close to the photosensitive drum is greater than an opening ratio of another region, it is possible to increase the charging performance and the image uniformity.

Accordingly, as shown in Table 1, it can be understood that in the image forming apparatus of the present invention, regardless of whether the image formation is carried out at an extremely high speed, by uniformly charging the photosensitive drum, the occurrence of image irregularities (half tone irregularities) can be notably suppressed.

EXPLANATION OF REFERENCE NUMERALS

10 sheet feed portion
30 image forming portion
31Y to 31B process cartridge
32 exposure device
33 transfer portion (transfer means)
34 fixing portion (fixing means)
50 control portion
100 laser beam printer (image forming apparatus)
310Y photosensitive drum
311Y scorotron charging device (charging device)
312Y developing device
610 discharge electrode (saw blade shape)
612 protruding portion (acutely shaped protruding portion)
670 grid electrode
671 upstream region
672 midstream region
673 downstream region
680 discharge electrode (wire shape)

What is claimed is:

1. A charging device which is disposed so as to face a surface of a photosensitive drum and which charges the surface of the photosensitive drum, comprising:

a discharge electrode, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions including an upstream region, a midstream region, and a downstream region which are arranged from upstream to downstream in this order in a direction along a direction of rotation of the photosensitive drum, the midstream region being located closer to the photosensitive drum as compared to the upstream region and the downstream region, and an opening ratio of the midstream region being greater than those of the upstream region and the downstream region.

2. The charging device according to claim 1, wherein the discharge electrode is of a saw blade shape having a plurality of acutely shaped protruding portions.

3. The charging device according to claim 2, further comprising a cleaning member which is provided so as to be movable relative to the discharge electrode, and which cleans a surface of at least one portion of the discharge electrode by scraping the at least one portion of the discharge electrode when moving.

4. The charging device according to claim 1, wherein the discharge electrode is of a wire shape.

5. The charging device according to claim 1, wherein a difference obtained by subtracting, from the opening ratio of the midstream region, the opening ratio of either one of the upstream region and the downstream region is 10 to 25%.

6. The charging device according to claim 1, wherein the upstream region and the downstream region have the same opening ratio.

7. The charging device according to claim 1, wherein the opening ratio of the upstream region is larger than the opening ratio of the downstream region.

8. The charging device according to claim 7, wherein a difference between the opening ratios of the upstream region and the downstream region is within 10%.

9. The charging device according to claim 1, wherein the opening ratio of the downstream region is larger than the opening ratio of the upstream region.

10. The charging device according to claim 9, wherein a difference between the opening ratios of the upstream region and the downstream region is within 10%.

11. The charging device according to claim 1, wherein a nickel layer comprising polytetrafluoroethylene is provided on at least one face of the discharge electrode.

12. A process cartridge comprising the charging device according to claim 1, the photosensitive drum which is charged by the charging device, and a developing device which develops an electrostatic latent image formed on the photosensitive drum by an exposure device and forms a toner image.

13. An image forming apparatus comprising an image forming portion comprising the process cartridge according to claim 12, the exposure device, a transfer means which transfers the toner image formed on the photosensitive drum to a sheet, and a fixing means which fixes the toner image transferred to the sheet onto the sheet, and a sheet feed portion which feeds a sheet to the image forming portion.

14. The charging device according to claim 1, wherein the opening ratio is uniform within each of the regions.

15. An image forming apparatus comprising a photosensitive drum, a charging unit, disposed so as to face a surface of the photosensitive drum, for charging the surface of the photosensitive drum and a developing unit for forming a toner image on the surface of the photosensitive drum by developing a latent image formed on the surface of the charged photosensitive drum, wherein the developing unit comprises a developing roll, comprising a developing sleeve which supports a developer on a surface, for adhering a toner included in the developer onto the photosensitive drum, and a developer layer thickness control member for controlling a layer thickness of the developer on the developing sleeve, for adjusting an amount of the toner adhering to the photosensitive drum, and wherein the developer is compacted by its own weight and a force originating from rotation towards the developer layer thickness control member of the developing sleeve, and a film thickness of the compacted developer is controlled by the developer layer thickness control member, the charging unit comprises a discharge electrode of a saw blade shape having a plurality of acutely shaped protruding portions, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions including an upstream region, a midstream region, and a downstream region which are arranged from upstream to downstream in this order in a direction along a direction of rotation of the photosensitive drum, the midstream region being located closer to the photosensitive drum as compared to the upstream region and the downstream region, and an opening ratio of the midstream region being greater than those of the upstream region and the downstream region.

16. An image forming apparatus comprising a photosensitive drum, a charging unit, disposed so as to face a surface of the photosensitive drum, for charging the surface of the photosensitive drum and a developing unit for forming a toner image on the surface of the photosensitive drum by developing a latent image formed on the surface of the charged photosensitive drum, wherein the developing unit comprises a developing roll, comprising a developing sleeve which supports a developer on a surface, for adhering a toner included in the developer onto the photosensitive drum, and a developer layer thickness control member for controlling a layer thickness of the developer on the developing sleeve, for adjusting an amount of the toner adhering to the photosensitive drum, and wherein the developer is compacted by its own weight and a force originating from rotation towards the developer layer thickness control member of the developing sleeve, and a film thickness of the compacted developer is controlled by the developer layer thickness control member, the charging unit comprises a discharge electrode of a wire shape, which carries out corona discharge, applies a voltage to the surface of the photosensitive drum and charges the surface, a grid electrode with a porous plate shape, which is disposed between the discharge electrode and the photosensitive drum so as to face the surface of the photosensitive drum and which controls a charging potential at the surface, wherein the grid electrode is divided into a plurality of regions including an upstream region, a midstream region, and a downstream region which are arranged from upstream to downstream in this order in a direction along a direction of rotation of the photosensitive drum, the midstream region being located closer to the photosensitive drum as compared to the upstream region and the downstream region, and an opening ratio of the midstream region being greater than those of the upstream region and the downstream region.

* * * * *